US010363735B2

(12) United States Patent
Morikawa

(10) Patent No.: US 10,363,735 B2
(45) Date of Patent: Jul. 30, 2019

(54) IMAGE PROCESSING APPARATUS AND NON-TRANSITORY COMPUTER-READABLE STORAGE MEDIUM STORING PROGRAM

(71) Applicant: Brother Kogyo Kabushiki Kaisha, Nagoya-shi, Aichi-ken (JP)

(72) Inventor: Shota Morikawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/026,306

(22) Filed: Jul. 3, 2018

(65) Prior Publication Data

US 2019/0009523 A1 Jan. 10, 2019

(30) Foreign Application Priority Data

Jul. 6, 2017 (JP) ..... 2017-132395

(51) Int. Cl.

| | |
|---|---|
| ***B41J 2/21*** | (2006.01) |
| ***B41J 2/045*** | (2006.01) |
| ***B41J 19/14*** | (2006.01) |
| *B41J 2/205* | (2006.01) |

(52) U.S. Cl.

CPC ..... *B41J 2/04508* (2013.01); *B41J 2/04586* (2013.01); *B41J 2/2103* (2013.01); *B41J 2/2132* (2013.01); *B41J 19/147* (2013.01); *B41J 2/2056* (2013.01)

(58) Field of Classification Search

CPC ..... B41J 2/04508; B41J 2/04586; B41J 2/21; B41J 19/147

See application file for complete search history.

(56) References Cited

U.S. PATENT DOCUMENTS

| | | | | |
|---|---|---|---|---|
| 8,292,389 | B2 | 10/2012 | Kuno | |
| 8,714,679 | B2 | 5/2014 | Kuno | |
| 10,005,289 | B2 * | 6/2018 | Kakutani | B41J 2/04508 |
| 2010/0214336 | A1 | 8/2010 | Kuno | |
| 2012/0213569 | A1 | 8/2012 | Kuno | |

FOREIGN PATENT DOCUMENTS

| | | | |
|---|---|---|---|
| JP | 2010-194882 | A | 9/2010 |
| JP | 2012-171143 | A | 9/2012 |

* cited by examiner

*Primary Examiner* — Thinh H Nguyen
(74) *Attorney, Agent, or Firm* — Banner & Witcoff, Ltd.

(57) ABSTRACT

An image processing apparatus repeats an ejection process for ejecting color materials by moving a print head in one of a forward direction and a reverse direction in a main scanning direction, and a moving process for moving a print medium in a sub-scanning direction. In a case where an L-th band image satisfies both of a first color condition and a second color condition, a direction of the ejection process is determined to be the same direction as the direction of moving of the print head in the ejection process for another band image including a predetermined number or more of pixels. Where the L-th band image does not satisfy at least one of the first color condition and the second color condition, the direction process of the ejection process is determined to be an opposite direction to moving of the print head in an (L−1)-th ejection process.

12 Claims, 9 Drawing Sheets

GD

300

Vk

| | | | WEIGHT | PASS 1 | PASS 2 | PASS 3 | ••• |
|---|---|---|---|---|---|---|---|
| 0 | 0 | 0 | 5 | 2 | 10 | 50 | ••• |
| 0 | 0 | 16 | 10 | 20 | 60 | 0 | ••• |
| ⋮ | ⋮ | ⋮ | ⋮ | ⋮ | ⋮ | ⋮ | ••• |
| 255 | 255 | 255 | 0 | 0 | 0 | 0 | ••• |

301 302 303

IMAGE PROCESSING APPARATUS AND NON-TRANSITORY COMPUTER-READABLE STORAGE MEDIUM STORING PROGRAM

CROSS-REFERENCE TO RELATED APPLICATION

This application claims priority from Japanese Patent Application No. 2017-132395 filed on Jul. 6, 2017, the content of which is incorporated herein by reference in its entirety.

TECHNICAL FIELD

Aspects disclosed herein relate to a technique for enabling a printing execution unit to execute image printing.

BACKGROUND

A known inkjet printer includes a print head that has nozzle groups corresponding to respective ink colors. The inkjet printer prints a color image by ejecting ink droplets of respective colors from the corresponding nozzle groups while causing the print head to scan in a main scanning direction. Such a printer may print an image corresponding to a band-shaped unit printing region (e.g., a band region) having the same width as a nozzle width (e.g., a length of a nozzle group) in a single scan by the print head. For implementing image printing onto a printing region having a larger size than a single band region, the printer alternately repeats printing of an image corresponding to a single band region and moving of a print medium in a sub-scanning direction. The inkjet printer may perform bidirectional printing in which printing is performed both when the print head scans in a forward direction of the main scanning direction and when the print head scans in a reverse direction of the main scanning direction. Such bidirectional printing may improve a printing speed as compared with an inkjet printer that performs unidirectional printing in which printing is performed when the print head scans in one of the forward direction and the reverse direction of the main scanning direction only.

Nevertheless, in the bidirectional printing, an ink overlapping order may be different between when the print head scans in the forward direction and when the print head scans in the reverse direction. Such difference in the ink overlapping order may cause a color gap between a result obtained by the forward-direction scanning and a result obtained by the reverse-direction scanning although both printed results represent the same color. Thus, an observer may recognize that the printed results have respective different colors. In order to reduce or prevent occurrence of such a phenomenon, there has been proposed a technique that calculates an index value relating to an estimated ink amount for each block included in a band region and determines, if the index value is greater than a threshold, a specific direction as the scanning direction.

SUMMARY

Nevertheless, in the known technique, although there is a low possibility that the observer recognizes that the colors of results to be printed representing the same color are different from each other if the results are obtained by scanning in the different ink overlapping orders in the bidirectional printing, the same direction as the print head scanning direction for the band region immediately preceding a target band region may be determined as the print head scanning direction for a target band region. This may cause unnecessary reduction of the printing speed.

Accordingly, some embodiments of the disclosure provide for a technique for improving a printing speed while reducing occurrence of a conspicuous color gap.

One illustrative aspect of the disclosure may provide an image processing apparatus for enabling a printing execution unit to execute image printing, the printing execution unit comprising a print head including a plurality of nozzle groups, the plurality of nozzle groups including a first nozzle group and a second nozzle group, the image processing apparatus comprising a controller configured to perform: acquiring target image data; determining a direction of moving of the print head among a forward direction and a reverse direction in a main scanning direction for band image data included in the target image data; and causing the printing execution unit to alternately repeat an ejection process and a moving process for enabling the printing execution unit to print a target image represented by the target image data, the ejection process for ejecting color materials onto a print medium by moving the print head in one of the forward direction and the reverse direction to form a band image represented by corresponding band image data along the main scanning direction using the plurality of nozzle groups, the ejection process includes a first ejection process and a second ejection process, the first ejection process for ejecting, by moving the print head in the forward direction, a first color material from the first nozzle group onto a first specific position of the print medium followed by a second color material from the second nozzle group, the second ejection process for ejecting, by moving the print head in the reverse direction, the second color material from the second nozzle group onto a second specific position of the print medium followed by the first color material from the first nozzle group, and the moving process for moving the print medium in a sub-scanning direction relative to the print head, wherein the controller determines the direction of moving of the print head by: determining whether an L-th (L is an integer of 2 or greater) band image formed by an L-th ejection process satisfies a first color condition, the first color condition associated with a color difference between a first image to be printed and a second image to be printed, the first image being printed by the first ejection process in the forward direction using a pixel included in an L-th band image data representing the L-th band image, and the second image being printed by the second ejection process in the reverse direction using a pixel included in the L-th band image data representing the L-th band image, determining whether the L-th band image satisfies a second color condition, the second color condition representing that a predetermined number or more of pixels in a specific color range are included in another band image different from the L-th band image, a pixel of the pixels being associated with a color difference between a color to be printed using the pixel in the first ejection process in the forward direction and a color to be printed using the pixel in the second ejection process in the reverse direction, the specific color range being a color range including a color represented by a pixel in the L-th band image; determining, as the direction of moving of the print head in the L-th ejection process, a same direction as the direction of moving of the print head in the ejection process for another band image including the predetermined number or more of the pixels in a case where it is determined that both of the first color condition and the second color condition are satisfied; and determining, as the direction of moving of the print head in the L-th ejection process, an opposite direction to moving of the print head in an (L−1)-th ejection process in a case where it is determined that at least one of the first color condition and the second color condition is not satisfied.

According to one or more aspects of the disclosure, in a case where the first and second color conditions are both satisfied, the same direction as the direction for ejection processing for a band image that includes a color-gap-causing pixel and that is other than the L-th band image is determined as the direction for the L-th ejection processing. Such control may thus reduce occurrence of a conspicuous color gap that may be caused by difference in the direction of ejection processing. In a case where one of the first and second color conditions is not satisfied, the direction opposite to the direction for the (L−1)-th ejection processing is determined as the direction for the L-th ejection processing. Such control may thus improve a printing speed.

The one or more aspects of the disclosure may be accomplished in various manners, such as using image processing methods, image processing apparatuses, printing methods, printing devices, computer-readable programs for implementing the methods or function of the apparatuses or devices, or storage media storing the computer-readable programs (e.g., non-transitory storage media).

BRIEF DESCRIPTION OF THE DRAWINGS

Aspects of the disclosure are illustrated by way of example and not by limitation in the accompanying figures in which like reference characters indicate similar elements.

DETAILED DESCRIPTION

A. First Illustrative Embodiment

Figure 1:
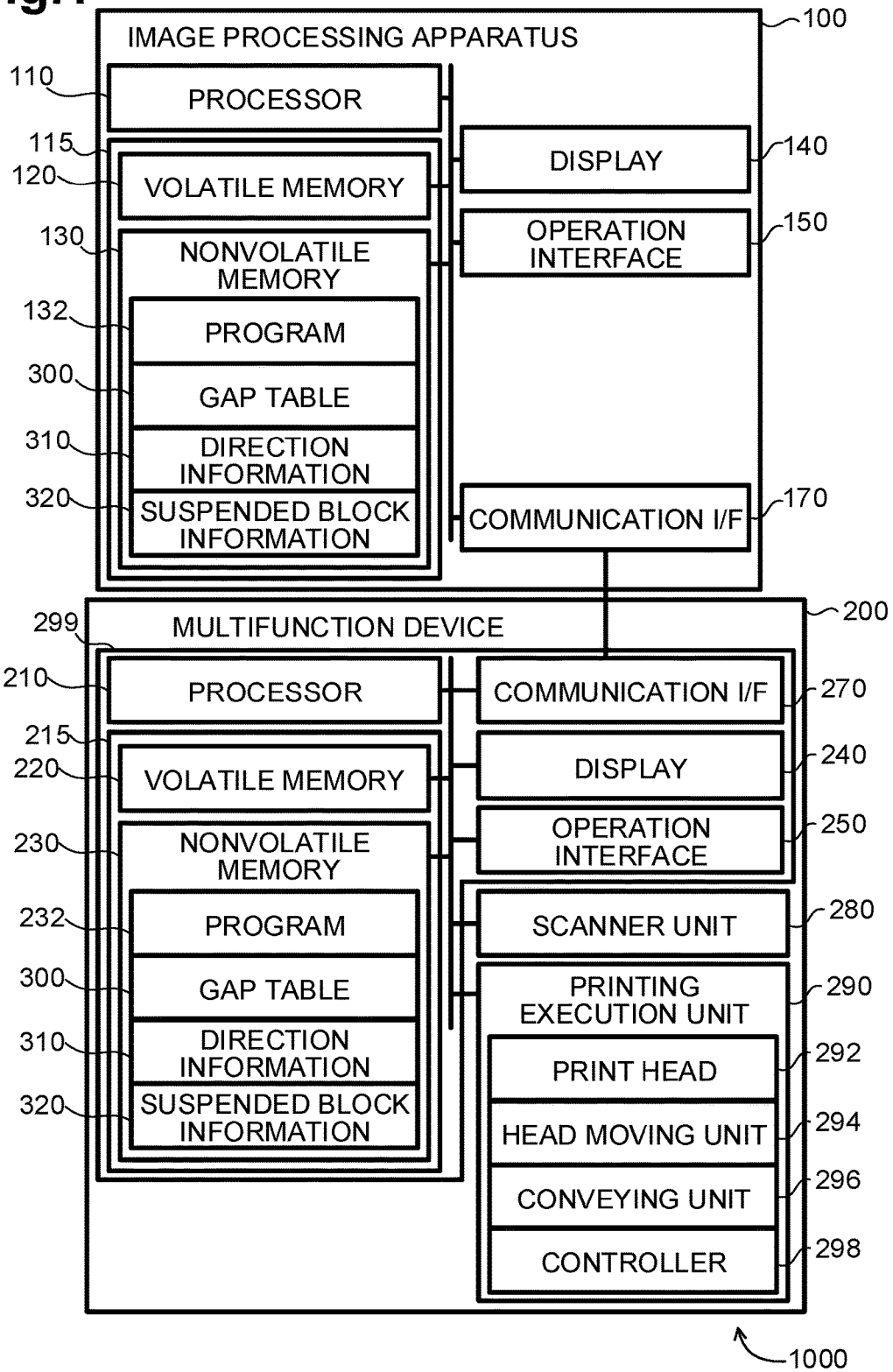
FIG. 1 illustrates an image processing system in a first illustrative embodiment according to one or more aspects of the disclosure.

Referring to FIG. 1, an image processing system 1000 according to a first illustrative embodiment will be described. The image processing system 1000 includes an image processing apparatus 100 and a multifunction device 200 connected to the image processing apparatus 100.

The image processing apparatus 100 may be a general-purpose computer such as a desktop computer or a tablet computer. The image processing apparatus 100 includes a processor 110, a memory 115, a display 140, an operation interface 150, and a communication interface (I/F) 170, which are connected to each other via a bus. The display 140 is configured to display an image. The operation interface 150 is configured to accept a user operation. The memory 115 includes a volatile memory 120 and a nonvolatile memory 130.

The processor 110 is configured to execute data processing. The processor 110 may be, for example, a CPU. The volatile memory 120 may be, for example, a DRAM. The nonvolatile memory 130 may be, for example, a flash memory.

The nonvolatile memory 130 may store a program 132, a gap table 300, direction information 310, and suspended block information 320. The processor 110 is configured to implement various functions by executing the program 132. The processor 110 may temporarily store various intermediate data to be used for execution of the program 132, in the memory 115 (e.g., one of the volatile memory 120 and the nonvolatile memory 130). In the first illustrative embodiment, the program 132 and the gap table 300 are included in a device driver provided by a manufacturer of the multifunction device 200. The direction information 310 and the suspended block information 320 are generated in image processing for printing.

The display 140 is configured to display an image. The display 140 may be, for example, a liquid crystal display. The operation interface 150 is configured to accept a user operation. The operation interface 150 may be, for example, a touch panel laminated over the display 140. The operation interface 150 enables the user to input various instructions to the image processing apparatus 100.

The communication interface 170 enables the image processing apparatus 100 to communicate with another device. The communication interface 170 may be, for example, a USB interface, a wired LAN interface, or an IEEE 802.11 wireless interface. The communication interface 170 is connected to the multifunction device 200.

The image processing apparatus 100 is configured to drive the multifunction device 200 to print an image in accordance with a user instruction.

The multifunction device 200 includes a scanner unit 280, a printing execution unit 290, and a controller 299. The scanner unit 280 is configured to read an object such as a document. The printing execution unit 290 is configured to print an image. The controller 299 is configured to control overall operations of the multifunction device 200. The controller 298 includes a processor 210, a memory 215, a display 240, an operation interface 250, and a communication interface (I/F) 270, which are connected to each other via a bus. The display 240 is configured to display an image.

The operation interface 250 is configured to accept a user operation. The memory 215 includes a volatile memory 220 and a nonvolatile memory 230.

The processor 210 is configured to execute data processing. The processor 210 may be, for example, a CPU. The volatile memory 220 may be, for example, a DRAM. The nonvolatile memory 230 may be, for example, a flash memory.

The nonvolatile memory 230 stores a program 232. The nonvolatile memory 230 may also store the gap table 300, the direction information 310, and the suspended block information 320 that are the same as those stored in the nonvolatile memory 130 of the image processing apparatus 100. The processor 210 is configured to implement various functions by executing the program 232. The processor 210 may temporarily store various intermediate data to be used for execution of the program 232 in the memory 215 (e.g., one of the volatile memory 220 and the nonvolatile memory 230). In the first illustrative embodiment, the program 232 and the gap table 300 are prestored as firmware in the nonvolatile memory 230 by the manufacturer of the multifunction device 200.

The display 240 is configured to display an image. The display 240 may be, for example, a crystal liquid display. The operation interface 250 is configured to accept a user operation. The operation interface 250 may be, for example, a touch panel laminated over the display 240. The operation interface 250 enables the user to input various instructions to the multifunction device 200.

The communication interface 270 enables the multifunction device 200 to communicate with another device. In the first illustrative embodiment, the communication interface 270 is connected to the communication interface 170 of the image processing apparatus 100.

The scanner unit 280 is configured to optically read an object such as a document using a photoelectric conversion element, such as a charge-coupled device ("CCD") or a complementary metal oxide semiconductor ("CMOS"), to generate scan data representing a read image (hereinafter, referred to as a "scan image"). The scan data may be, for example, RGB bitmap data representing a color scan image.

The printing execution unit 290 is configured to print an image onto a sheet (an example of a print medium). The printing execution unit 290 includes a print head 292, a head moving unit 294, a conveying unit 296, and a controller 298. The controller 298 is configured to control the print head 292, the head moving unit 294, and the conveying unit 296. The printing execution unit 290 may be an inkjet printer configured to perform printing using one or more of cyan (C) ink, magenta (M) ink, yellow (Y) ink, and black (K) ink. Nevertheless, in other embodiments, for example, another ink color combination (e.g., cyan C, magenta M, and yellow Y) may be adopted.

The multifunction device 200 is configured to enable the printing execution unit 290 to print an image using print data provided by another device (e.g., the image processing apparatus 100). The multifunction device 200 is further configured to optically read an object to generate scan data representing the object by driving the scanner unit 280 in accordance with a user instruction. The multifunction device 200 is further configured to enable the printing execution unit 290 to print an image represented by the scan data.

Figure 2A:
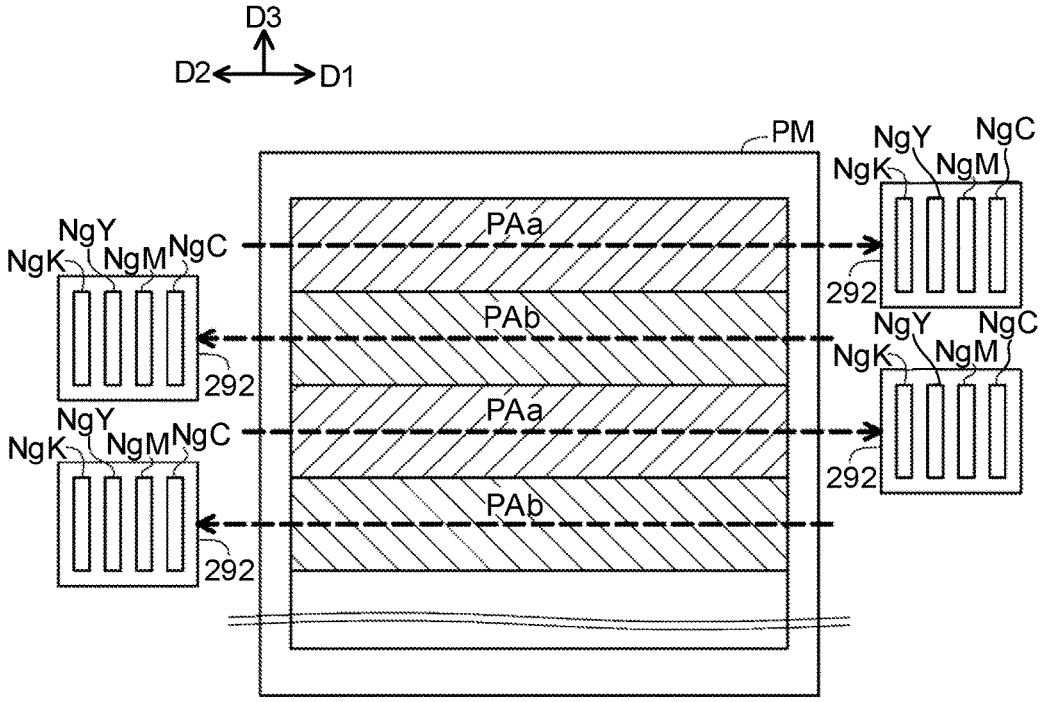
FIG. 2A is an explanatory diagram for explaining band regions defined on a sheet and a moving direction of a print head in the first illustrative embodiment according to one or more aspects of the disclosure.

Referring to FIG. 2A, an explanation will be provided on band regions PAa and PAb defined on a sheet PM and a moving direction of the print head 292. A main scanning direction includes a first direction D1 and a second direction D2. The first direction D1 and the second direction D2 are opposite to each other. The head moving unit 294 (refer to FIG. 1) is configured to reciprocate the print head 292 along a direction parallel to the main scanning direction. Although not illustrated, the head moving unit 294 includes a rail, a plurality of pulleys, a belt, and a motor. The rail supports and allows the print head 292 to slide along the main scanning direction. The belt is looped around the pulleys. A portion of the belt is attached to the print head 292. The motor is configured to rotate the pulleys. As the motor rotates the pulleys, the print head 292 moves along the main scanning direction.

In FIG. 2A, a third direction D3 refers to a sub-scanning direction (hereinafter, also referred to as the "sub-scanning direction D3"). The conveying unit 296 (refer to FIG. 1) is configured to convey a sheet PM in the sub-scanning direction D3 relative to the print head 292. Although not illustrated, the conveying unit 296 includes a table, an upstream roller, a downstream roller, and a motor. The table is disposed facing the print head 292. The table is configured to support a sheet PM thereon. The upstream roller is disposed upstream from the print head 292 in the sub-scanning direction. The downstream roller is disposed downstream from the print head 292 in the sub-scanning direction. The motor is configured to rotate the upstream and downstream rollers. The upstream and downstream rollers are configured to convey a sheet PM in the sub-scanning direction D3. In the first illustrative embodiment, the sub-scanning direction D3 is perpendicular to the main scanning direction.

Figure 2B:
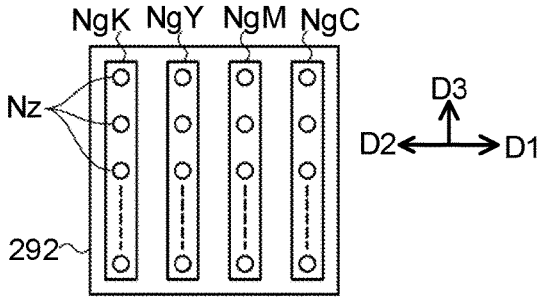
FIG. 2B illustrates a nozzle arrangement in a bottom surface of the print head in the first illustrative embodiment according to one or more aspects of the disclosure.

Referring to FIG. 2B, an explanation will be provided on a nozzle arrangement in a bottom surface of the print head 292. As illustrated in FIG. 2B, the print head 292 includes, in the bottom surface thereof, a nozzle group NgC for ejecting cyan (C) ink, a nozzle group NgM for ejecting magenta (M) ink, a nozzle group NgY for ejecting yellow (Y) ink, and a nozzle group NgK for ejecting black (K) ink. In each of the nozzle groups NgC, NgM, NgY, and NgK, nozzles Nz are positioned at different positions with respect to the sub-scanning direction. In the first illustrative embodiment, in each of the nozzle groups NgC, NgM, NgY, and NgK, the nozzles Nz are positioned along the sub-scanning direction. Further, the nozzles Nz are linearly aligned along the sub-scanning direction. Nevertheless, in other embodiments, for example, at least some of the nozzles Nz may be positioned at different positions with respect to the main scanning direction (e.g., in a staggered arrangement). The nozzle groups NgC, NgM, NgY, and NgK are positioned side by side in this order along the main scanning direction (more specifically, for example, in the second direction D2).

As illustrated in FIG. 2A, the printing execution unit 290 (refer to FIG. 1) ejects ink droplets from appropriate nozzles Nz of the nozzle groups NgC, NgM, NgY, and NgK onto a sheet PM while moving the print head 292 along the main scanning direction, thereby printing an image on each of band regions PAa and PAb of the sheet PM. Hereinafter, the image printed on a single band region is referred to as a band image. The band regions PAa and PAb are defined on the sheet PM and extend along the main scanning direction. In response to completion of printing of a single band image, the printing execution unit 290 conveys the sheet PM by a predetermined conveying amount in the sub-scanning direction D3. The band image represents a partial image of a print-target image and corresponds to a single band region PAa or PAb. The predetermined conveying amount of the sheet PM corresponds to a width of a single band region PAa or PAb (i.e., a width of a single band image) in the sub-scanning direction D3. The printing execution unit 290 repeats printing of a single band image and conveyance of the sheet PM alternately to print the entire print-target image on the sheet PM. Hereinafter, processing for printing a band image on a single band region of a sheet PM by ejecting ink droplets from the print head 292 while moving the print head 292 along the main scanning direction is referred to as "ejection processing" or "pass". The first direction D1 is also referred to as a "forward direction D1". The second direction D2 is also referred to as a "reverse direction D2".

In FIG. 2A, the band region PAa may be a band region in which a band image is to be printed by the print head 292 moving in the forward direction D1 (the band region PAa is also referred to as a "forward-direction band region PAa"). The band region PAb may be a band region in which a band image is to be printed by the print head 292 moving in the reverse direction D2 (the band region PAb is also referred to as a "reverse-direction band region PAb"). In the example of FIG. 2A, the forward-direction band regions PAa and the reverse-direction band regions PAb are positioned side by side alternately in the sub-scanning direction D3. The print head 292 is configured to print a band image while moving in the forward direction D1 of the main scanning direction. The print head 292 is also configured to print a band image while moving in the reverse direction D2 of the main scanning direction. This configuration may therefore enable high-speed printing. Nevertheless, in some cases, the ejection processing in the same direction may be executed two or more times successively.

Figure 2C:
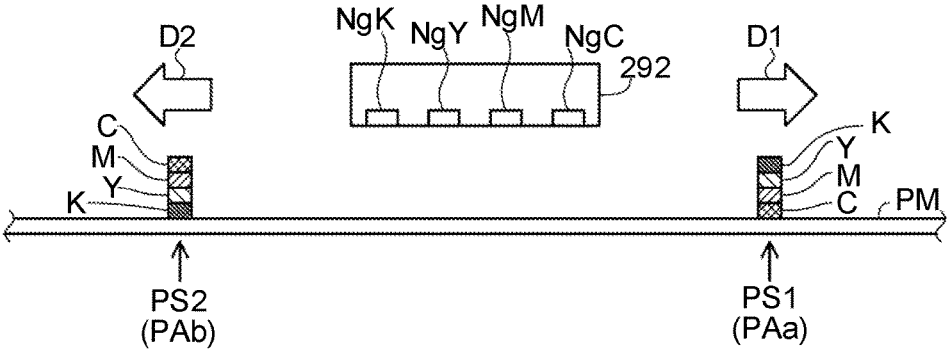
FIG. 2C is an explanatory diagram for explaining each ink overlapping order in which inks overlap one above another on a sheet in the first illustrative embodiment according to one or more aspects of the disclosure.

Referring to FIG. 2C, an explanation will be provided on an order in which different color inks overlap one above another (referred to as an "ink overlapping order") on the sheet PM. FIG. 2C illustrates the print head 292 and the sheet PM as viewed in the sub-scanning direction D3. As illustrated in FIG. 2C, in a forward-direction band region PAa, cyan (C) ink, magenta (M) ink, yellow (Y) ink, and black (K) ink overlap one above another at the same position PS1 in this order from a surface of the sheet PM. For enabling the print head 292 moving in the forward direction D1 to place cyan (C) ink, magenta (M) ink, yellow (Y) ink, and black (K) on the same position PS1, the print head 292 is caused to eject cyan (C) ink, magenta (M) ink, yellow (Y) ink, and black (K) ink sequentially in this order from the nozzle group NgC, the nozzle group NgM, the nozzle group NgY, and the nozzle group NgK, respectively. As illustrated in FIG. 2C, in a reverse-direction band region PAb, black (K) ink, yellow (Y) ink, magenta (M) ink, and cyan (C) ink overlap one above another at the same position PS2 in this order from the surface of the sheet PM. For enabling the print head 292 moving in the forward direction D2 to place cyan (C) ink, magenta (M) ink, yellow (Y) ink, and black (K) on the same position PS2, the print head 292 is caused to eject black (K) ink, yellow (Y) ink, magenta (M) ink, and cyan (C) ink sequentially in this order from the nozzle group NgK, the nozzle group NgY, the nozzle group NgM, and the nozzle group NgC, respectively. That is, the ink overlapping order (i.e., the ink ejecting order) in the ejection processing in the reverse direction D2 is inverse of the ink overlapping order (i.e., the ink ejecting order) in the ejection processing in the forward direction D1.

In a case where the different ink overlapping orders are used in printing for representing the same color, a color represented by inks overlapping in one ink overlapping order may look different from a color represented by the same inks overlapping in the other ink overlapping order although both of the colors are represented by inks that are the same in type and in amount per unit area by ink. For example, in FIG. 2C, a color represented by inks overlapping at the position PS1 may look different from a color represented by the same inks overlapping at the position PS2.

Figure 3:
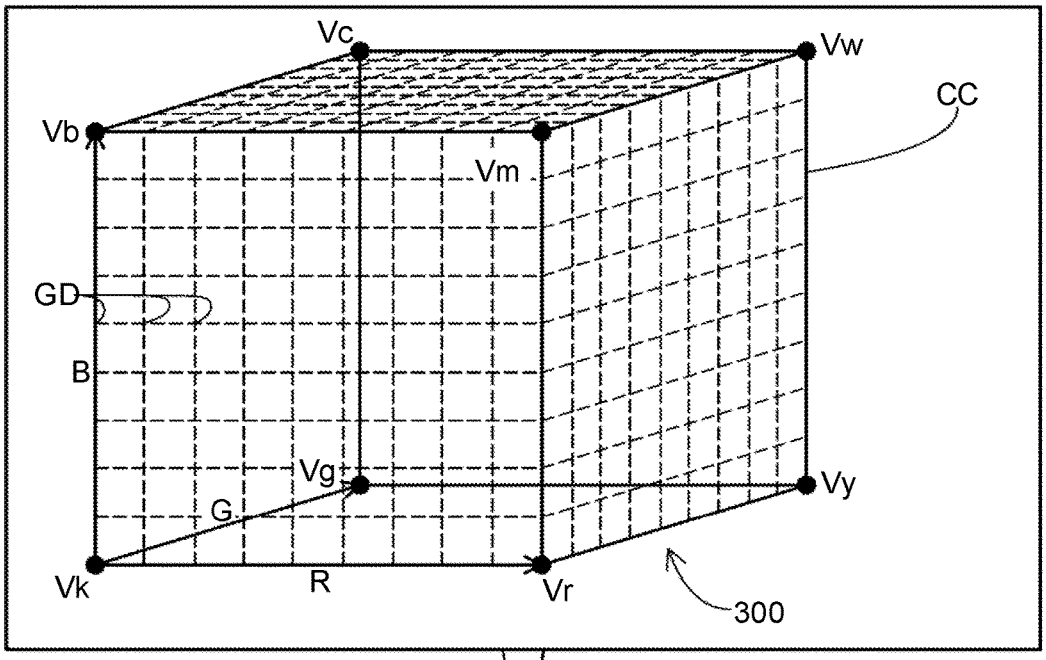
FIG. 3 illustrates a gap table in the first illustrative embodiment according to one or more aspects of the disclosure.

Referring to FIG. 3, an explanation will be provided on the gap table 300 (refer to FIG. 1). FIG. 3 illustrates a color cube CC represented by RGB color components. The color cube CC has eight vertexes, which are assigned with respective symbols. More specifically, for example, the vertexes are assigned with a black vertex Vk (0, 0, 0), a red vertex Vr (255, 0, 0), a green vertex Vg (0, 255, 0), a blue vertex Vb (0, 0, 255), a cyan vertex Vc (0, 255, 255), a magenta vertex Vm (255, 0, 255), a yellow vertex Vy (255, 255, 0), and a white vertex Vw (255, 255, 255), respectively. Numerals in parenthesis represent values of color components of red R, green G, and blue B. A value of red R in each grid GD is any one of (Q+1) values obtained by equally dividing a range (e.g., 0 to 255) of red R into Q (Q is, for example, 9 or 17). The same is applied to green G and blue B of each grid GD.

FIG. 3 also illustrates an example of the gap table 300. The gap table 300 shows a correspondence between an RGB pixel value 301, a weight 302, and a pixel frequency (per pass) 303 for each of the grids GD included in the color cube CC. Each RGB pixel value 301 indicates a pixel value (e.g., combinations of gradation values of red R, green G, and blue B) of a corresponding grid GD. Each weight 302 indicates a degree of color gap assigned to a corresponding grid GD. The degree of color gap indicates a degree of color gap caused between printed images due to difference in direction of ejection processing (i.e., due to difference in ink overlapping order). For example, a grid GD assigned with a greater weight may cause a larger degree of color gap between printed results due to the difference in ink overlapping order. In the first illustrative embodiment, each weight 302 is determined based on a degree of color gap caused between a printed first patch and a printed second patch each corresponding to the same corresponding grid GD. The first patch is printed by the ejection processing in the forward direction D1 based on a pixel value (represented by three components of red R, green G, and blue B) of a corresponding grid GD in the color cube CC. The second patch is printed by the ejection processing in the reverse direction D2 based on the same pixel value. Each of the first and second patches is an image having a uniform color represented by a single pixel value. For each RGB pixel value, an amount of each color ink, e.g., cyan (C) ink, magenta (M) ink, yellow (Y) ink, and black (K) ink, per unit area is predetermined. The first and second patches associated with the same grid GD are printed using the same amount of each color ink, e.g., cyan (C) ink, magenta (M) ink, yellow (Y) ink, and black (K) ink, per unit area, but are printed in the different ink ejecting orders (i.e., in the different ink overlapping orders). More specifically, the ink ejecting order for the first patch is inverse of the ink ejecting order for the second patch. When the user observes the printed first and second patches, colors of the first and second patches may look different from each other due to the difference in the ink ejecting order (i.e., the ink overlapping order). Such a color gap may be referred to as a "color gap caused due to the difference in ink overlapping order".

In the gap table 300, each weight 302 indicates a degree of color gap caused between a first patch and a second patch (i.e., a degree of color gap caused due to the difference in ink overlapping order) for a corresponding grid GD. For example, each weight 302 indicates a value corresponding to the degree of color gap (e.g., a distance between colors in a CIELab color space) determined based on measured values (e.g., color values in an L*a*b* color space) of first and second patches. More specifically, for example, a greater weight 302 may be assigned to a corresponding grid GD that causes a relatively larger degree of color gap caused between a first patch and a second patch both printed based on the same grid GD. The gap table 300 defines a correspondence between an RGB pixel value 301 and a weight 300 for each of the grids GD included in the color cube CC. Such correspondences are predetermined. For example, each correspondence between an RGB pixel value 301 and a weight 300 for a corresponding grid GD is determined by the manufacture of the multifunction device 200. In the gap table 300, a pixel frequency (per pass) 303 for each grid GD is updated in processing for printing and then used.

Figure 4:
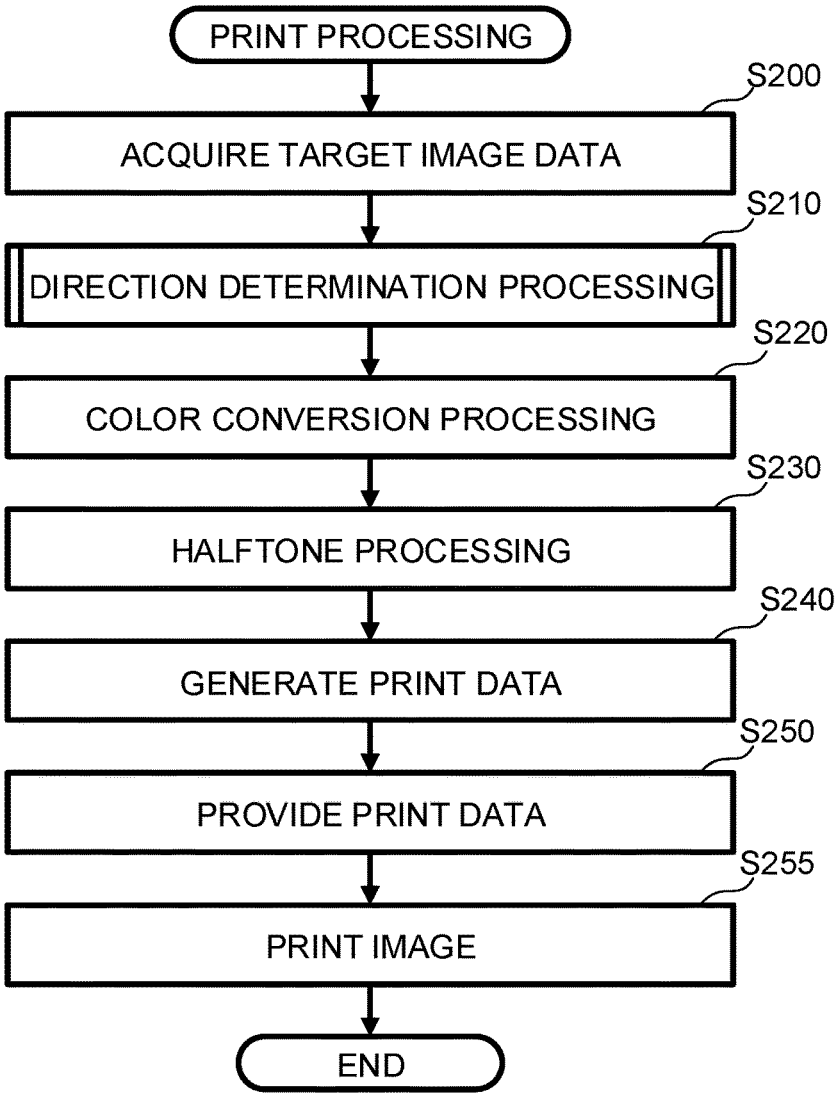
FIG. 4 is a flowchart of print processing in the first illustrative embodiment according to one or more aspects of the disclosure.

Referring to FIG. 4, print processing will be described. In the first illustrative embodiment, the processor 110 of the image processing apparatus 100 executes the print processing (refer to FIG. 4) in accordance with the program 132. In response to a print start instruction inputted by the user through the operation interface 150, the processor 110 starts the print processing.

In step S200, the processor 110 acquires image data to be printed (hereinafter, also referred to as "target image data"). For example, the processor 110 acquires image data specified in the print start instruction provided by the user or by an application program, as target image data. It is assumed, in the first illustrative embodiment, that the target image data is bitmap data and a pixel value of each pixel constituting the target image data is represented by 256 gradations of a 0 to 255 RGB (red, green, blue) value. In a case where the specified image data has a format (e.g., Enhanced Meta File (EMF) format) different from bitmap format, the processor 110 uses bitmap data obtained by data format conversion (e.g., rasterization), as the target image data. In a case where a pixel density of the image data differs from a predetermined pixel density suitable for print processing, the processor 110 converts the pixel density of the image data into the pixel density suitable for print processing.

In step S210, the processor 110 identifies a plurality of band images (refer to FIG. 2A) constituting a target image represented by the target image data, and determines, with respect to each of the band images, one of the forward direction D1 and the reverse direction D2 as a direction of ejection processing for printing a corresponding band image. Partial data representing a single band image in the target image data may also be referred to as "band image data" or "band data".

In step S220, the processor 110 converts the pixel value of each pixel constituting the target image data from the RGB value to a CMYK value corresponding to color components of print color materials. A correspondence between the RGB value and the CMYK value is defined in a lookup table (not illustrated) pre-stored in the nonvolatile memory 130. The processor 110 executes the color conversion by referring to the lookup table. The lookup table is included in a device driver provided by the manufacturer of the multifunction device 200. The nonvolatile memory 230 of the multifunction device 200 pre-stores the same lookup table as part of the firmware.

In step S230, the processor 110 executes halftone processing using the image data on which the color conversion has undergone. An error diffusion method may be used as the halftone processing. Nevertheless, in other embodiments, for example, a method using a dither matric may be used.

In step S240, the processor 110 generates band print data for printing a single band image, using the result of the halftone processing. The band print data may be data in a format that can be interpreted by the controller 298 of the printing execution unit 290 of the multifunction device 200. The band print data includes information representing the direction (e.g., the forward direction D1 or the reverse direction D2) of ejection processing for printing a corresponding band image, information representing a result (e.g., an ink dot pattern) of the halftone processing, and information representing a conveying amount of a sheet PM in the conveying processing to be executed after the ejection processing. The processor 110 generates band print data for each of the plurality of band images constituting the target image. The information representing the direction of ejection processing is determined with reference to the direction information 310 (refer to FIG. 1).

In step S250, the processor 110 provides all band print data to the multifunction device 200 in a sequential order in which band images each represented by corresponding band print data are to be printed onto the sheet PM. The processor 210 of the multifunction device 200 further provides the received band print data to the printing execution unit 290. In step S255, the controller 298 of the printing execution unit 290 controls the print head 292, the head moving unit 294, and the conveying unit 296 in accordance with the received band print data, to execute the ejection processing and the conveying processing alternately. Thus, printing of a band image and conveyance of the sheet PM are repeated alternately, thereby printing the target image.

In one example, the processor 110 may start providing generated band print data to the multifunction device 200 sequentially without waiting completion of generation of all band print data for a target image. In such a case, prior to completing receipt of all band print data for the target image, the processor 210 of the multifunction device 200 may allow the printing execution unit 290 to start printing of a band image based on the received print data.

As described above, the processor 110 of the image processing apparatus 100 controls the multifunction device 200 (by extension, the printing execution unit 290) by generating print data (e.g., step S240) and providing the generated print data to the multifunction device 200 (e.g., step S250). More specifically, for example, the processor 110 causes the printing execution unit 290 to alternately repeat ejection processing for printing a band image and moving processing for moving a sheet PM in the sub-scanning direction relative to the print head 292, thereby causing the printing execution unit 290 to execute image printing. Subsequent to step S200, the processor 110 determines, with respect to each of the band images, the direction of ejection processing for printing a corresponding band image (e.g., step S210).

Figure 5:
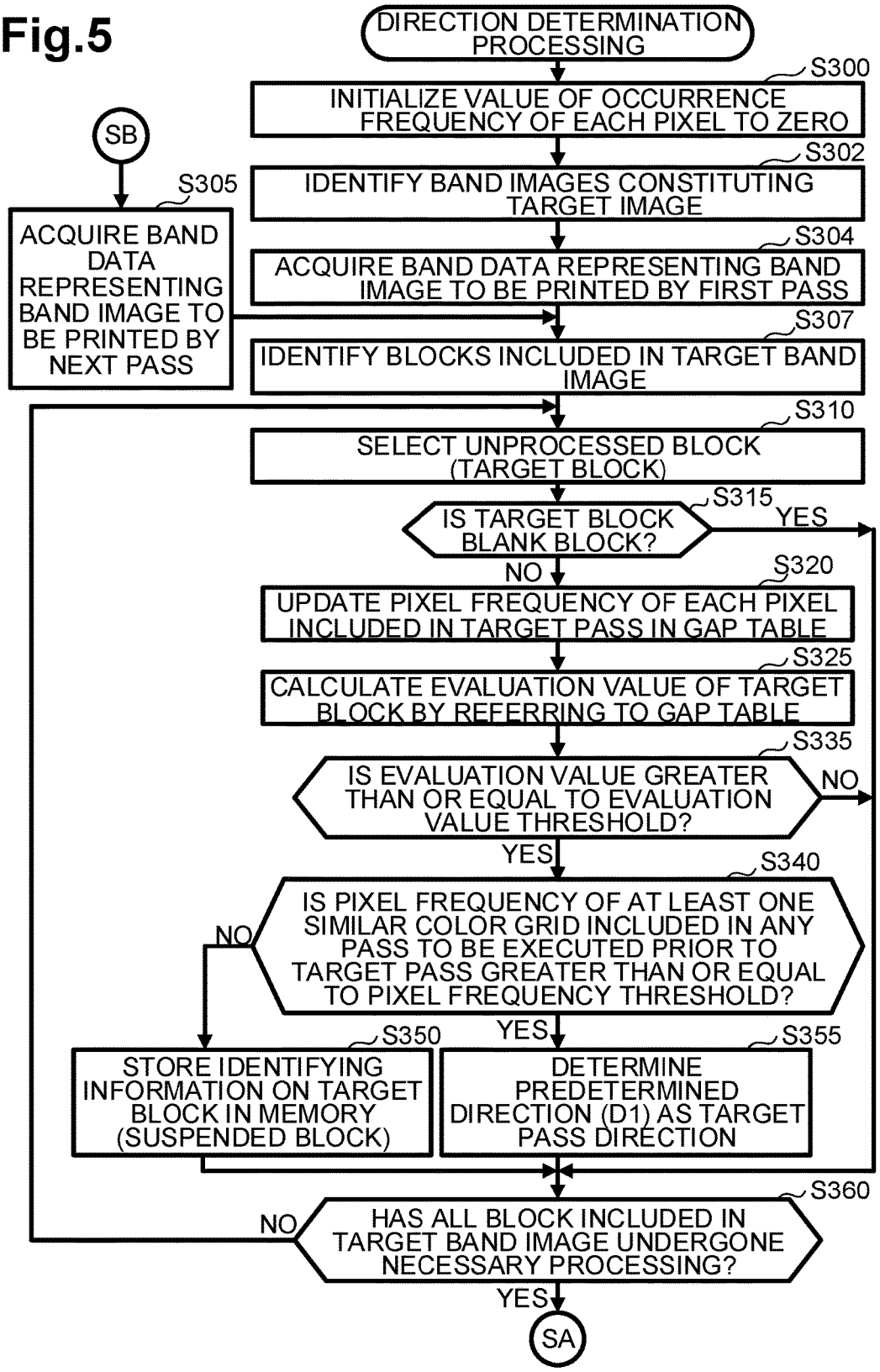
FIG. 5 is a flowchart of direction determination processing for determining a direction for each ejection processing in the first illustrative embodiment according to one or more aspects of the disclosure.
Figure 6:
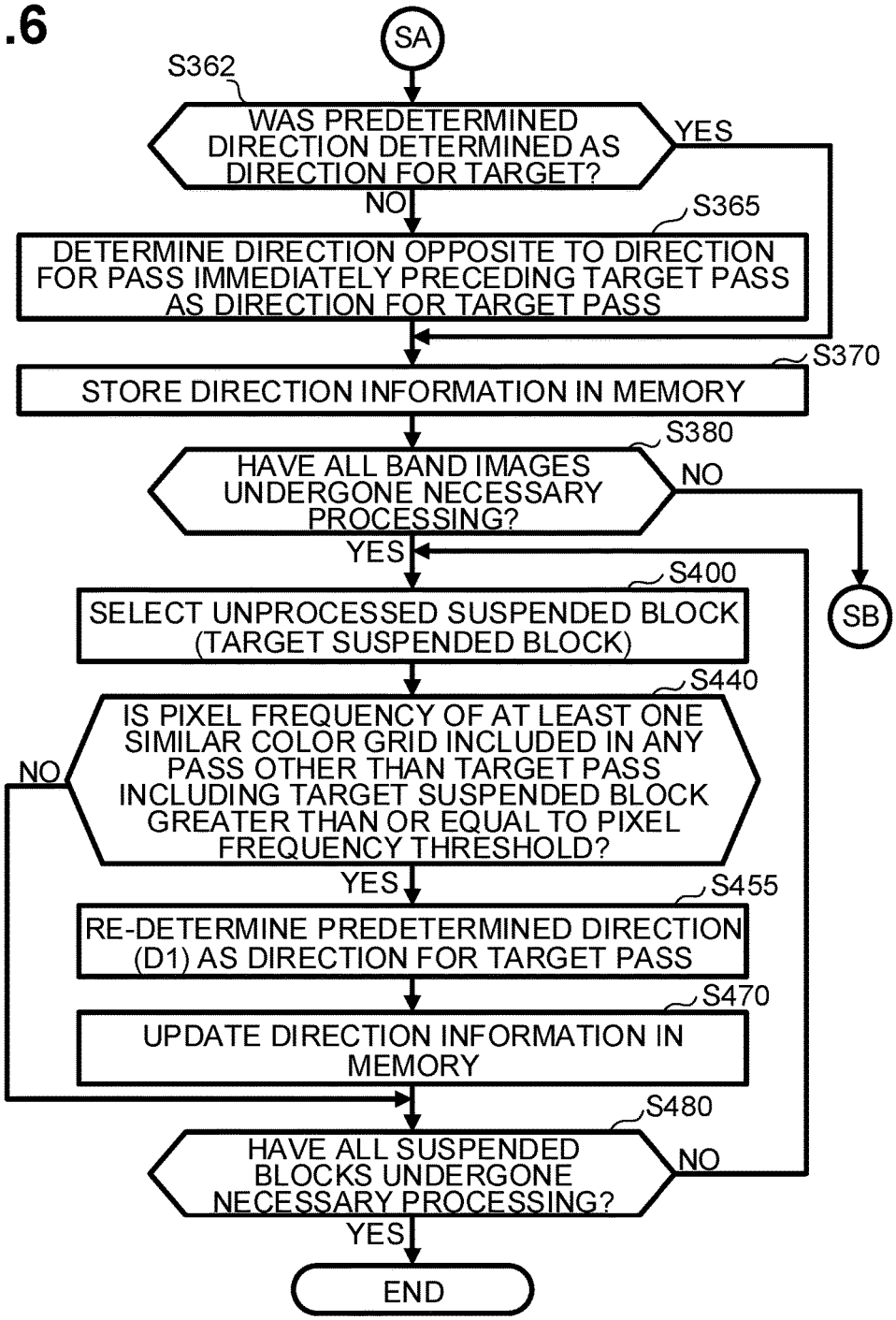
FIG. 6 is a continuation of the flowchart of FIG. 5 in the first illustrative embodiment according to one or more aspects of the disclosure.
Figure 7:
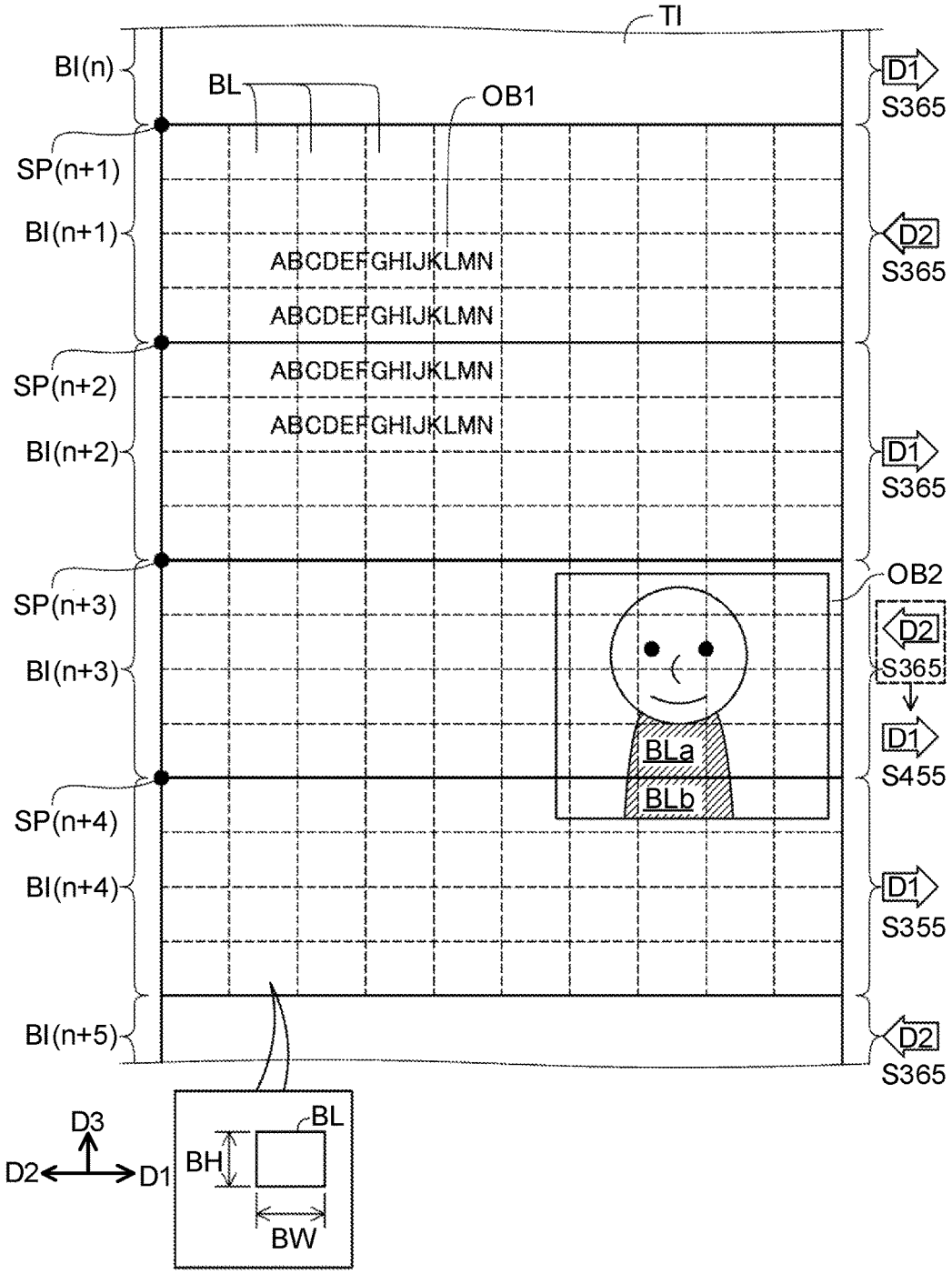
FIG. 7 illustrates an example of a plurality of band images in the first illustrative embodiment according to one or more aspects of the disclosure.

Referring to FIGS. 5 and 6, direction determination processing for determining the direction of ejection processing will be described. As illustrated in FIG. 5, in step S300, the processor 110 initializes, to zero, the value of the pixel frequency 303 of each pixel included in each pass in the gap table 300. In step S302, the processor 110 identifies a plurality of band images constituting the target image. Referring to FIG. 7, the plurality of band images will be described in detail. FIG. 7 illustrates a portion of a target image TI. The target image TI includes a first object OB1 and a second object OB2. The first object OB1 may be letter strings. The second object OB2 may be a photograph. FIG. 7 illustrates n-th to (n+5)-th band images BI(n) to BI(n+5) of a plurality of band images constituting the target image TI (n is an integer). A position and size of each band image on a sheet PM (refer to FIG. 2A) is predetermined. In the first illustrative embodiment, a target image is divided into a plurality of band images positioned side by side in the sub-scanning direction D3. The sheet PM is conveyed in the sub-scanning direction D3. Therefore, the band images are sequentially printed one after another at respective predetermined positions upstream from an immediately preceding printed band image in the sub-scanning direction D3. The processor 110 identifies, based on the position of the target image on the sheet PM, a plurality of band images constituting the target image.

In step S304 (refer to FIG. 5), the processor 110 acquires, from the target image data, particular band data representing a band image to be printed by a first pass ("Pass 1"), as processing-target band data (also referred to as "target band data"). The band image to be printed by the first pass may be a band image to be printed at a most downstream position in the sub-scanning direction D3 among the band images of the target image and to be printed prior to the one or more other band images.

In step S307, the processor 110 identifies a plurality of blocks BL included in the target band image. In the first illustrative embodiment, the processor 110 determines a position of each block BL on the target band image with reference to a reference position SP associated with the target band image. As illustrated in FIG. 7, reference positions SP(n+1) to SP(n+4) are defined in the respective band images BI(n+1) to BI(n+4). In the first illustrative embodiment, the reference position SP of the target band image may be a predetermined position on the target band image. More specifically, for example, the reference position SP may be a left corner of the target band image (i.e., a corner located at a downstream end of the target band image in the reverse direction D2 and at a downstream end of the target band image in the sub-scanning direction D3).

As illustrated in FIG. 7, each block BL has a rectangular shape. Each block BL has a predetermined height BH in the sub scanning direction D3 and a predetermined width BW in the main scanning direction. In each band image, the blocks BL are arranged in a grid pattern along the main scanning direction and the sub-scanning direction D3 without any space therebetween. A left corner of one of the blocks BL coincides with a corresponding reference position SP.

In step S310 (refer to FIG. 5), the processor 110 selects one of one or more unprocessed blocks BL from the blocks BL included in the target band image (hereinafter, the selected unprocessed block is referred to as a "target block"). In step S315, the processor 110 determines whether the target block is a blank block. If all pixels included in the target block are included within a predetermined color range including a particular pixel representing a background (e.g., within a predetermined color range including a pixel representing white), the processor 110 determines that the target block is a blank block.

If the processor 110 determines that the target block is a blank block (e.g., YES in step S315), the routine proceeds to step S360. In step S360, the processor 110 determines whether all of the blocks BL included in the target band image has undergone the necessary processing. If the processor 110 determines that at least one of the blocks BL has not undergone the necessary processing (e.g., NO in step S360), the routine returns to step S310.

If the processor 110 determines that the target block is not a blank block (e.g., NO in step S315), the target block BL includes at least a portion of an object. In such a case, in step S320, the processor 110 updates the pixel frequency 303 of each pixel included in the target pass in the gap table 300. The target pass corresponds to ejection processing for printing the target band image. For example, in a case where the target band image corresponds to a band image to be printed by first ejection processing, the processor 110 updates the pixel frequency 303 of each pixel included in a first pass ("Pass 1"). Each pixel frequency 303 indicates an occurrence frequency of a corresponding pixel in a band image. For example, in a case where the target block includes a single pixel having a pixel value of the black vertex Vk (refer to FIG. 3), in step S320, the pixel frequency 303 of the pixel corresponding to the black vertex Vk is increased by 1 (one). In a case where a particular pixel of the target block has a pixel value that is between a plurality of grids GD in the color cube CC, the pixel frequency 303 of a pixel corresponding to a grid GD having the closest pixel value to the pixel value of the particular pixel is increased by 1 (one). In the first illustrative embodiment, the processor 110 updates the pixel frequency 303 of each pixel included in the target block.

As described above, in the first illustrative embodiment, the pixel frequency 303 associated with each grid GD defined in the gap table 300 indicates a total pixel frequency of a plurality of pixels included within a predetermined color range (also referred to as a grid color range) including a pixel corresponding to a grid GD. Respective pixels included in a single grid color range represent similar colors to each other. In other words, the pixel frequency 303 of each grid GD indicates a total of the pixel frequency of each of pixels representing respective colors similar to the color represented by the grid GD. In a case where a particular grid GD is assigned with a relatively large weight 302, generally, each pixel included within the grid color range of the particular grid GD may cause a relatively large degree of color gap due to the difference in ink overlapping order.

In step S325, the processor 110 calculates an evaluation value of the target block by referring to the gap table 300. More specifically, for example, the processor 110 determines a weight for each pixel included in the target block by referring to the gap table 300 (refer to FIG. 3). In a case where the target block includes a pixel having a pixel value that is between a plurality of grids GD in the color cube CC, the processor 110 determines the weight 302 assigned to a grid GD having the closest pixel value to the pixel value of the target pixel as the weight 302 for the target pixel. Nevertheless, the weight for the target pixel may be calculated by interpolation (e.g., triangular pyramid interpolation) that uses a plurality of grids GD having pixel values close to the pixel value of the target pixel. Then, the processor 110 calculates an average value of the weights assigned to the respective pixels included in the target block, and determines the obtained value as an evaluation value of the target block. A larger evaluation value may indicate that a relatively large degree of color gap may be observed by the observer between an image printed by ejection processing in the forward direction D1 using a particular pixel included in the target block and an image printed by ejection processing in the reverse direction D2 using the same pixel included in the target block.

In step S335, the processor 110 determines whether the evaluation value is greater than or equal to an evaluation value threshold. A pixel assigned with a relatively large weight that causes an evaluation value to be greater than or equal to the evaluation value threshold (e.g., a pixel included within a grid color range of a grid GD assigned with a relatively large weight 302) may be an example of a pixel that may cause a relatively large degree of color gap due to the difference in ink overlapping order (hereinafter, also referred to as a "color-gap-causing pixel"). In the first illustrative embodiment, the evaluation value threshold is predetermined. If the processor 110 determines that the evaluation value is smaller than the evaluation value threshold (e.g., NO in step S335), the routine proceeds to step S360.

If the processor 110 determines that the evaluation value is greater than or equal to the evaluation value threshold (e.g., YES in step S335), in step S340, the processor 110 determines, by referring to the gap table 300, whether the pixel frequency of a determination-target pixel included in any pass to be executed prior to the target pass is greater than or equal to the pixel frequency threshold. The determination-target pixel may be a pixel representing a similar color to a color of a particular one of pixels included in the target block. In step S340, the processor 110 performs the same determination on each pixel representing a respective similar color to a color of a respective particular one of the pixels included in the target block. In the first illustrative embodiment, the pixel frequency threshold is predetermined.

More specifically, for example, in step S340, the processor 110 determines, by referring to the gap table 300, one or more grids GD each corresponding to a corresponding one of the grid color ranges including respective ones of the one or more pixels included in the target block. Each grid GD determined in step S340 has an approximate pixel value to the pixel value of a corresponding one of the one or more pixels included in the target block. Each grid GD determined in step S340 represents a similar color to a color of a corresponding one of the one or more pixels included in the target block. Hereinafter, each grid GD determined in step S340 may also be referred to as a similar color grid. A pixel value of a similar color grid may be referred to as a similar pixel value. In a single target block, one or more similar color grids may be determined.

Subsequently, the processor 110 determines, by referring to the gap table 300, whether the pixel frequency of at least one similar color grid included in any pass to be executed prior to the target pass is greater than or equal to the pixel frequency threshold. It is assumed that the current target pass is a third pass ("Pass 3"), the pixel frequency threshold is "9", and a grid corresponding to the black vertex Vk is selected as a similar color grid. This example will be described by referring to the gap table 300 (refer to FIG. 3). In Pass 2 to be executed prior to the target pass ("Pass 3"), the pixel frequency of the similar color grid Vk indicates "10", which is greater than the pixel frequency threshold. Therefore, the processor 110 determines that the pixel frequency of at least one similar color grid included in any pass to be executed prior to the target pass is greater than or equal to the pixel frequency threshold. Thus, the processor 110 makes a positive determination (e.g., "YES") in step S340.

If the processor 110 makes a negative determination (e.g., "NO") in step S315 and makes a positive determination (e.g., "YES") in step S340, one or more band images to be printed prior to the target image include a pixel that represents a similar color to a color represented by a pixel included in the target block and that may cause a relatively large color gap due to the difference in ink overlapping order. In such a case, in step S355, the processor 110 determines a predetermined direction (e.g., the forward direction D1) as the target pass direction. Subsequent to step S355, the routine proceeds to step S360.

In FIG. 7, an arrow is illustrated to the right of each band image BI. Each arrow indicates a pass direction (i.e., a direction of ejection processing for printing a corresponding band image). The band image BI(n+3) includes a block BLa, and the band image BI(n+4) includes a block BLb. The blocks BLa and BLb represent partial portions of the second object OB. The blocks BLa and BLb represent the same color that is represented by the same pixel that may cause a relatively large color gap due to the difference in ink overlapping order. Here, it is assumed that the band image BI(n+4) is specified as the current target band image and the block BLb is specified as the current target block. In such a case, the processor 110 determines that the target block BLb is not a blank block (e.g., NO in step S315), and that the evaluation value of the target block BLb is greater than or equal to the evaluation value threshold (e.g., YES in step S335). The block BLa of the band image BI(n+3) to be printed prior to the target band image BI(n+4) includes a pixel whose pixel frequency is greater than or equal to the pixel frequency threshold and which represents a similar color to a color of a pixel included in the target block BLb. Therefore, the processor 110 makes a positive determination (e.g., "YES") in step S340. In such a case, the processor 110 determines the forward direction D1 as the pass direction for the target band image BI(n+4). The processor 110 also determines the forward direction D1 as the pass direction for one or more other band images each including the pixel whose pixel frequency is greater than or equal to the pixel frequency threshold and which represents a similar color to the color of the pixel included in the target block BLb. For example, the processor 110 determines the forward direction D1 as the pass direction for the target band image BI(n+3) finally although determining the reverse direction D2 as the pass direction for the target band image BI(n+3) previously. As described above, in a case where two or more band images included in the target image include respective pixels that represent similar colors to each other and that may cause a relatively large color gap due to the difference in ink overlapping order, the processor 110 determines the same direction (e.g., the forward direction D1) as the pass direction of each of the two or more band images. Such control may thus reduce occurrence of a conspicuous color gap that may be caused by the difference in pass direction.

If the processor 110 makes a positive determination (e.g., "YES") in step S335 and makes a negative determination (e.g., "NO") in step S340, the target block includes a pixel that may cause a relatively large color gap due to the difference in ink overlapping direction. Nevertheless, any band image to be printed prior to the target image does not include a pixel representing a similar color to the color of the pixel included in the target block. In such a case (e.g., NO in step S340), the processor 110 suspends determination of the direction for the target pass that is made based on the target block (hereinafter, such a target block is also referred to as a "suspended block"). The processor 110 stores identifying information on the suspended block in the memory 115 (e.g., the nonvolatile memory 130 in the first illustrative embodiment) (refer to FIG. 1) as part of the suspended block information 320. Block identifying information may be information for identifying a corresponding one of blocks included in each band image. For example, the block identifying information may indicate the location of a suspended block on a sheet PM.

In the example of FIG. 7, the block BLa of the band image BI(n+3) includes a pixel that may cause a relatively large color gap due to the difference in ink overlapping direction. Nevertheless, any band image to be printed prior to the band image BI(n+3) does not include a pixel representing a similar color to the color of the pixel included in the block BLa. Thus, in a case where the band image BI(n+3) is specified as the target band image, the processor 110 does not execute the determination of the pass direction for the band image BI(n+3) in step S355 if the block BLa is specified as the target block. Thus, in step S350, the processor 110 determines the block BLa as a suspended block, and stores the identifying information on the suspended block BLa in the nonvolatile memory 130 as part of the suspended block information 320.

Subsequent to step S355, the routine proceeds to step S360. If the processor 110 determines that all of the blocks BL included in the target band image have undergone the necessary processing (e.g., YES in step S360), in step S362 (refer to FIG. 6), the processor 110 determines whether the predetermined direction was determined as the direction for the target pass in step S355 (refer to FIG. 5). If the processor 110 determines that the predetermined direction was determined as the direction for the target pass in step S355 (e.g., YES in step S362), the routine proceeds to step S370.

If the processor 110 determines that the direction for the target pass has not been determined (e.g., NO in step S362), in step S365, the processor 110 determines the direction opposite to the direction for the pass immediately preceding the target pass as the direction for the target pass provisionally. Subsequent to step S365, the routine proceeds to step S370. Thus, in the example of FIG. 7, in step S355, the processor 110 does not determine the pass direction for the band image BI(n+3). In step S365, the processor 110 then determines the direction (e.g., the reverse direction D2) opposite to the direction for the pass immediately preceding the target pass as the pass direction for the band image BI(n+3). In a case where the first pass is specified as the target pass, the processor 110 determines the predetermined direction (e.g., the forward direction D1) as the direction for the target pass.

In step S370 (refer to FIG. 6), the processor 110 stores the direction information 310 indicating the direction for the target pass in the memory 115 (e.g., the nonvolatile memory 130 in the illustrative embodiment) (refer to FIG. 1). In step S380, the processor 110 determines whether all of the band images (i.e., all of the passes) have undergone the necessary processing. If the processor 110 determines that at least one of the band images has not undergone the necessary processing (e.g., NO in step S380), the routine returns to step S305 (refer to FIG. 5). In step S305, the processor 110 selects a band image for the next pass as the target band image and acquires band data representing the target band image as processing-target data. Subsequent to step S305, the routine proceeds to step S307. The processor 110 executes processing of steps S307 to S380 on the current target image (i.e., another pass).

As described above, the processor 110 repeats processing of steps S307 to S380 on each of the band images constituting the target image. Thus, in step S355 or S365, the processor 110 provisionally determines the pass direction for each of the band images constituting the target image. In the example of FIG. 7, the processor 110 provisionally determines the pass direction for each of the band images BI(n+1), BI(n+2), BI(n+3), and BI(n+5) in step S365, and the pass direction for the band image BI(n+4) in step S355.

At this moment, the direction information 310 (refer to FIG. 1) includes each information indicating the provisionally-determined pass direction for a corresponding band image. The gap table 300 (refer to FIG. 3) stores the pixel frequency 303 of each grid GD included in each pass for printing the target image. The suspended block information 320 (refer to FIG. 1) includes each identifying information on a corresponding suspended block identified in a corresponding one of the band images constituting the target image.

If the processor 110 determines that all of the band images have undergone the necessary processing (e.g., YES in step S380), in step S400, the processor 110 selects, by referring to the suspended block information 320 (refer to FIG. 1), one of the one or more unprocessed suspended blocks as a processing-target suspended block (hereinafter, referred to as a "target suspended block").

In step S440, the processor 110 determines, by referring to the gap table 300, whether the pixel frequency of a determination-target pixel included in any pass other than the target pass including the target suspended block is greater than or equal to the pixel frequency threshold. The determination-target pixel may be a pixel representing a similar color to a color of a particular one of pixels included in the target suspended block. In step S440, the processor 110 performs the same determination on each pixel representing a respective similar color to a color of a respective particular one of the pixels included in the target suspended block. Processing executed in step S440 is similar to the processing executed in step S340 in FIG. 5. Nevertheless, in step S440, the processor 110 makes a determination based on not only one or more passes to be executed prior to the target pass but based on all passes other than the target pass.

If the processor 110 makes a positive determination (e.g., "YES") in step S440, another pass different from the target pass includes a portion that is to be represented by a pixel that represents a similar color to a color of a pixel included in the target suspended block and that may cause a relatively large degree of color gap due to the difference in ink overlapping order. In such a case, in step S455, the processor 110 re-determines the predetermined direction (e.g., the forward direction D1) as the direction for the target pass. In step S470, the processor 110 overwrites the existing information indicating the direction for the target pass included in the direction information 310 stored in the memory 115 (e.g., the nonvolatile memory 130) with new information indicating the forward direction D1 re-determined in step S455. Subsequent to step S470, the routine proceeds to step S480.

In the example of FIG. 7, the processor 110 selects the block BLa of the band image BI(n+3) as the target suspended block (e.g., step S400 (refer to FIG. 6)). The block BLb of the band image BI(n+4) to be printed by another pass different from the pass for the band image BI(n+3) includes at least one pixel whose pixel frequency is greater than or equal to the pixel frequency threshold and which represents a similar color to the color of a pixel included in the target suspended block BLa and may cause a relatively large degree of color gap due to the difference in ink overlapping order. Therefore, the processor 110 makes a positive determination (e.g., "YES") in step S440. Thus, in step S455, the processor 110 re-determines the predetermined direction (e.g., the forward direction D1) as the pass direction for the band image BI(n+3).

In step S480 (refer to FIG. 6), the processor 110 determines, by referring to the suspended block information 320 (refer to FIG. 1), whether all of the suspended blocks have undergone the necessary processing. If the processor 110 determines that at least one of the suspended blocks BL has not undergone the necessary processing (e.g., NO in step S480), the routine returns to step S400. If the processor 110 determines that all of the suspended blocks have undergone the necessary processing (e.g., YES in step S480), the processor 110 ends the direction determination processing (refer to FIGS. 5 and 6).

As described above, in the first illustrative embodiment, in step S210 (refer to FIG. 4), the processor 110 determines, with respect to each band image data included in the target image data, one of the forward direction D1 and the reverse direction D2 of the main scanning direction as the moving direction of the print head 292. Then, the processor 110 generates print data based on the determined moving directions of the print head 202 (e.g., step S240), and provides the generated print data to the multifunction device 200 including the printing execution unit 290 (e.g., step S250). Thus, the processor 110 causes the printing execution unit 290 to alternately repeat the ejection processing for printing ejecting color materials onto a sheet PM while moving the print head 292 in one of the forward direction D1 and the reverse direction D2, and the moving processing for moving a sheet PM in the sub-scanning direction D3 relative to the print head 292, thereby enabling the printing execution unit 290 to print a target image represented by target image data.

As described in FIGS. 2A, 2B, and 2C, the ejection processing may be for forming a band image represented by band image data along the main scanning direction using the nozzle groups NgC, NgM, NgY, and NgK by executing either of the processing for ejecting color materials from the respective nozzle groups NgC, NgM, NgY, and NgK onto a specific position of a sheet PM while moving the print head 292 in the forward direction D1 and the processing for ejecting color materials from the respective nozzle groups NgC, NgM, NgY, and NgK onto a specific position of a sheet PM while moving the print head 292 in the reverse direction D2. In a case where the print head 292 moves in the forward direction D1 during ejection processing, the print head 292 ejects color materials from the nozzle groups NgC, NgM, NgY, and NgK, respectively, in this order. More specifically, for example, the print head 292 ejects cyan color material from the cyan nozzle group NgC and then ejects magenta color material from the magenta nozzle group NgM. In a case where the print head 292 moves in the reverse direction D2 during ejection processing, the print head 292 ejects color materials from the nozzle groups NgK, NgY, NgM, and NgC, respectively, in this order. More specifically, for example, the print head 292 ejects magenta color material from the magenta nozzle group NgM and then ejects cyan color material from the cyan nozzle group NgC.

The direction of the ejection processing for each band image may be determined as described below. In step S335 (refer to FIG. 5), the processor 110 determines whether an L-th band image to be formed by L-th (L is an integer of 2 or greater) ejection processing satisfies a first color condition. The first color condition may be that the evaluation value of the block included in the L-th band image is greater than or equal to the evaluation value threshold. That is, the first color condition may be that a relatively large color gap may occur between a color of a first image to be printed by ejection processing in the forward direction D1 using a pixel included in L-th band image data representing the L-th band image and a color of a second image to be printed by ejection processing in the reverse direction D using the same pixel.

Thereafter, in steps S340 (refer to FIG. 5) and S440 (refer to FIG. 6), the processor 110 determines whether the L-th band image satisfies a second color condition. The second color condition may be that a pixel frequency 303 of at least one particular pixel in a band image other than the L-th band image is greater than or equal to the pixel frequency threshold. The particular pixel may be a pixel that represents a similar color to a pixel included in the L-th band image and that may cause a relatively large color gap due to the difference in ink overlapping order. As described above (e.g., step S320 in FIG. 5), each pixel frequency 303 associated with a corresponding one of the grids GD defined in the gap table 300 (refer to FIG. 3) indicates a total pixel frequency of a plurality of pixels included within a grid color range including a pixel corresponding to a respective grid GD. In a case where a particular grid GD is assigned with a relatively large weight 302, each pixel included within the grid color range of the particular grid GD may cause a relatively large degree of color gap due to the difference in ink overlapping order. That is, the second color condition may be that any band image other than the L-th image includes a predetermined number (e.g., the pixel frequency threshold) or more of color-gap-causing pixels included in a specific color range including the pixel included in the L-th band image. The color-gap-causing pixel may be a pixel that is included in a specific color range and that may cause a relatively large color gap due to the difference in ink overlapping order between a color of an image to be printed by ejection processing in the forward direction D1 using the color-gap-causing pixel and a color of another image to be printed by ejection processing in the reverse direction D using the same color-gap-causing pixel. In the first illustrative embodiment, a pixel included within a grid color range of a grid GD assigned with a relatively large weight 302 (e.g., the weight 302 that causes an evaluation value of a block BL to be greater than or equal to the evaluation value threshold) may be an example of the color-gap-causing pixel.

The processor 110 determines the direction for the target pass based on whether one or both of the first and second color conditions are satisfied.

(1) If the processor 110 determines that the first color condition is satisfied (e.g., YES in step S335) and the second color condition is also satisfied (e.g., YES in step S340 or YES in step S440), in step S355 or S455, the processor 110 determines the same direction (e.g., the forward direction D1) as the direction of the ejection processing for the band image that includes the "color-gap-causing pixel" and that is other than the target image, as the direction of the L-th ejection processing.

(2) If the processor 110 determines that one of the first color condition and the second color condition is not satisfied (e.g., NO in step S335, or NO in step S340 and NO is step S440), the processor 110 determines the direction that is opposite to the direction of the (L−1)-th ejection processing, as the direction of the L-th ejection processing (e.g., step S365).

As described above, in a case where the first and second color conditions are both satisfied, the same direction as the direction for ejection processing for a band image that includes a color-gap-causing pixel and that is other than the L-th band image is determined as the direction for the L-th ejection processing. Such control may thus reduce occurrence of a conspicuous color gap that may be caused by difference in the direction of ejection processing. In a case where one of the first and second color conditions is not satisfied, the direction opposite to the direction for the (L−1)-th ejection processing is determined as the direction for the L-th ejection processing. In such a case, bidirectional printing is to be executed. In such bidirectional printing, ejection processing for a specific band image is executed while the print head 292 moves to one side in the main scanning direction. Thereafter, ejection processing for the next band image is executed without the print head 292 being returned to the other side in the main scanning direction. That is, the next ejection processing is started from the one side. Such control may thus improve a printing speed.

As described in steps S307 to S325 (refer to FIG. 5), the processor 110 determines, by referring to the gap table 300, an evaluation value of at least one of a plurality of pieces of block data representing respective blocks BL included in a band image. The gap table 300 defines a correspondence between the RGB pixel value 301 and the weight 302 for each of the grids GD included in the color cube CC. Each weight 302 indicates a degree of color gap assigned to a corresponding grid GD. The degree of color gap indicated by a weight 302 may indicate a degree of color gap between a first color of an image to be printed by ejection processing in the forward direction D1 using a corresponding pixel and a second color of another image to be printed by ejection processing in the reverse direction D using the same pixel. The processor 110 determines, based on the evaluation value, whether the first color condition is satisfied (e.g., step S335). As described above, the processor 110 appropriately determines, based on the evaluation value of the block data, whether the first color condition is satisfied.

As illustrated in the first object OB1 in FIG. 7, each block BL has a size sufficient to include an entire portion of a single letter (e.g., each block BL is capable of including a letter of 10.5 point). Each block BL has such a size because of the following reasons. In a case where a plurality of letters represented by the same pixel that may cause a relatively large color gap due to the difference in ink overlapping order are printed in a plurality of lines and a direction of ejection processing for printing letters in one line is different from a direction of ejection processing for printing letters in another line, a color of the letters in the one line may look different from a color of the letters in the another line. Nevertheless, the letters may be represented by relatively thin lines. Therefore, there is a low possibility that a color gap is conspicuous if the color gap occurs between the letters in the one line and the letters in the other line. Thus, in a case where letters (in particular, relatively small letters, such as letters having a font size of 10.5 points or smaller) represented by pixels having the same pixel value corresponding to a grid GD that may cause a relatively large color gap due to the difference in ink overlapping order are printed in a plurality of lines, the direction for each ejection processing may be determined such that bidirectional printing is executed for printing a plurality of letter lines. That is, the directions of all ejection processing for printing the plurality of letter lines might not necessarily be the same direction. While reducing occurrence of a conspicuous color gap that may be caused by the difference in pass direction, such control may thus improve a printing speed.

In the first illustrative embodiment, any block BL may include one or more letters. In a case where a block BL includes one or more letters, the block BL represents both the letters and a background. The letters may be represented by relatively thin lines. Therefore, in the block BL, a total number of pixels representing the letters may be less than a total number of pixels representing the background. Therefore, if the block BL includes relatively small letters represented by pixels having the same pixel value corresponding to a grid GD that may cause a relatively large degree of color gap due to the difference in ink overlapping order, the evaluation value of the block BL may be a relatively small value due to a weight assigned to a grid GD corresponding to the pixel value of the pixels representing the background. Such control may thus reduce determining the same direction as the direction for each ejection processing for printing one of band images including letter lines if letters included in the letter lines have a relatively small size, thereby improving a printing speed.

Each weight 302 defined in the gap table 300 may indicate a degree of color gap between a color value (e.g., a measured value) representing a first color of an image to be printed by ejection processing in the forward direction D1 and a color value (e.g., a measured value) representing a second color of another image to be printed by ejection processing in the reverse direction D. For example, in a case where each weight 302 is determined based on results of human evaluation in which an observer observes the patches, the weights 302 may be determined improperly due to unintended mistake made by the observer. According to the first illustrative embodiment, the weights 302 are determined using the values that are not based on the results of such human evaluation. Therefore, the processor 110 may properly determine an evaluation value based on the one or more weights 302 defined in the gap table 300.

As described above, if the processor 110 determines that the first color condition is satisfied (e.g., YES in step S335) and the second color condition is also satisfied (e.g., YES in step S340 or YES in step S440), the processor 110 determines a predetermined one (e.g., the forward direction D1) of the forward direction D1 and the reverse direction D2, as the direction of ejection processing for the target band image. In the first illustrative embodiment, as described above, the predetermined direction is determined as the direction of ejection processing for the target band image. Such control may thus reduce or prevent the direction determination processing from being complicated and may also reduce occurrence of a conspicuous color gap that may be caused by difference in the direction of ejection processing. Nevertheless, in step S355 or S455, the processor 110 may determine the reverse direction D2 as the direction of the ejection processing for the target band image.

As described in step S320 (refer to FIG. 5), the processor 110 determines the pixel frequency (e.g., the pixel frequency 303 per pass of each of one or more grids GD assigned with relatively large weights 302, respectively) of each of one or more color-gap-causing pixels in each band image, using band image data. In step S340 (refer to FIG. 5), if an L-th band image is specified as the target band image, the processor 110 determines, based on the pixel frequency of each of the one or more color-gap-causing pixels included in each of first to (L−1)-th band images, whether the second color condition is satisfied. Using the pixel frequency of each of the one or more color-gap-causing pixels included in one or more band images to be printed prior to the target image may thus enable appropriate determination.

As described in FIGS. 2A to 2C, the printing execution unit 290 is configured to operate as described below. In a case where the printing execution unit 290 prints an image onto a sheet PM while moving the print head 292 in the forward direction D1, the printing execution unit 290 ejects color materials from the nozzle groups NgC, NgM, NgY, and NgK in this order onto the same position of the sheet PM. More specifically, for example, the printing execution unit 290 ejects cyan color material from the cyan nozzle group NgC onto the sheet PM and then ejects magenta color material from the magenta nozzle group NgM onto the same position of the sheet PM. In a case where the printing execution unit 290 prints an image onto the sheet PM while moving the print head 292 in the reverse direction D2, the printing execution unit 290 ejects color materials from the nozzle groups NgK, NgY, NgM, and NgC in this order onto the same position of the sheet PM. More specifically, for example, the printing execution unit 290 ejects magenta color material from the magenta nozzle group NgM onto the sheet PM and then ejects cyan color material from the cyan nozzle group NgC onto the same position of the sheet PM. In the first illustrative embodiment, the direction of each ejection processing for printing a band image is determined as described above. Therefore, even in a case where the ink ejecting order is different between the ejection processing in the forward direction D1 and the ejection processing in the reverse direction D2, such control may reduce occurrence of a conspicuous color gap that may be caused by difference in the direction of ejection processing.

B. Second Illustrative Embodiment

Figure 8A:
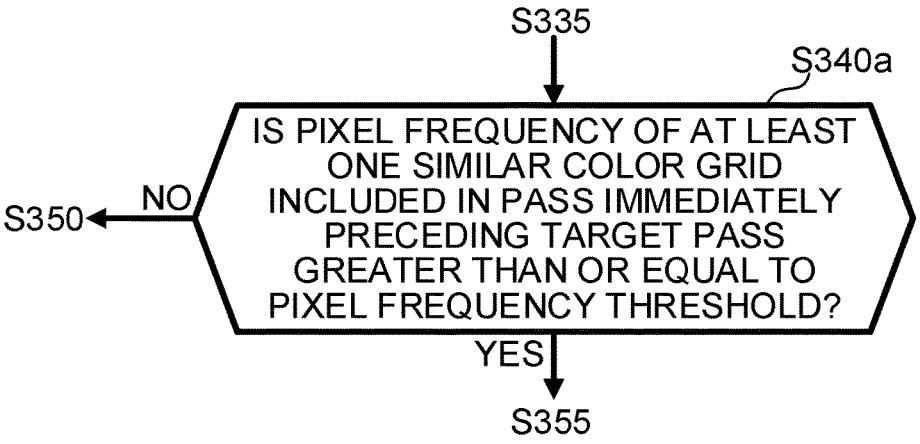
FIGS. 8A and 8B are each a partial flowchart of the direction determination processing in a second illustrative embodiment according to one or more aspects of the disclosure.
Figure 8B:
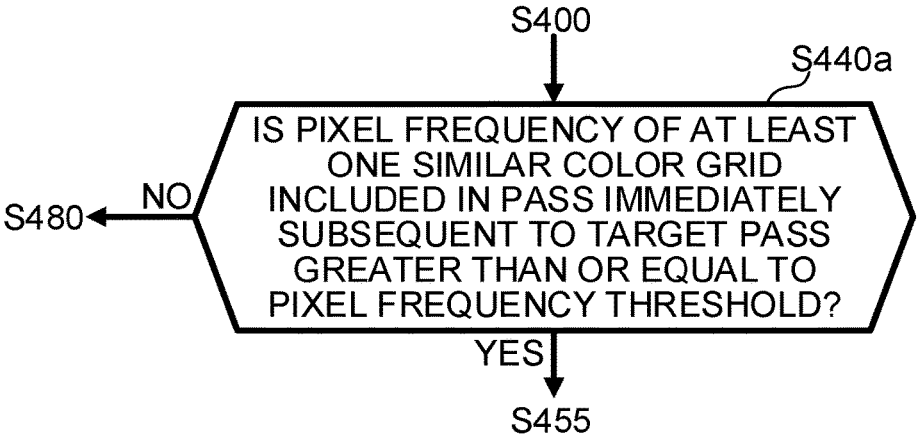

Referring to FIGS. 8A and 8B, an explanation will be provided on another example of the direction determination processing according to a second illustrative embodiment. In the second illustrative embodiment, processing of step S340*a* (refer to FIG. 8A) is executed instead of the processing of step S340 (refer to FIG. 5), and processing of step S440*a* (refer to FIG. 8B) is executed instead of the processing of step S440 (refer to FIG. 6). Processing executed in each of the other steps is the same or similar to the processing executed in a respective corresponding step in FIGS. 5 and 6.

In step S340*a* (refer to FIG. 8A), the processor 110 determines, by referring to the gap table 300, whether the pixel frequency of a determination-target pixel included in the pass immediately preceding the target pass is greater than or equal to the pixel frequency threshold. The determination-target pixel may be a pixel representing a similar color to a color of a particular one of pixels included in the target block. In step S340*a*, the processor 110 performs the same determination on each pixel representing a respective similar color to a color of a respective particular one of the pixels included in the target block. If the processor 110 determines that the pixel frequency of at least one of the determination-target pixels in the pass immediately preceding the target pass is greater than or equal to the pixel frequency threshold, the processor 110 makes a positive determination (e.g., "YES) in step S340*a*. In the first illustrative embodiment, in step S340 (refer to FIG. 5), the processor 110 determines whether a particular condition is satisfied based on the pixel frequency of at least one particular pixel included in any band images to be printed prior to the target band image. Nevertheless, in the second illustrative embodiment, in step S340*a*, the processor 110 determines whether the particular condition is satisfied using the pixel frequency of at least one particular pixel included in the band image to be printed immediately preceding the target band image. That is, the condition used in step S340*a* may be that, when an L-th band image is specified as the target band image, an (L−1)-th band image includes a predetermined number (e.g., the pixel frequency threshold) or more of color-gap-causing pixels included in a specific color range including a pixel including in the L-th band image.

In step S440*a* (refer to FIG. 8B), the processor 110 determines, by referring to the gap table 300, whether the pixel frequency of a determination-target pixel included in the pass immediately subsequent to the target pass including the target suspended block is greater than or equal to the pixel frequency threshold. The determination-target pixel may be a pixel representing a similar color to a color of a particular one of pixels included in the target block. In step S340*a*, the processor 110 performs the same determination on each pixel representing a respective similar color to a color of a respective particular one of the pixels included in the target block. If the processor 110 determines that the pixel frequency of at least one of the determination-target pixels in the pass immediately subsequent to the target pass including the target suspended block is greater than or equal to the pixel frequency threshold, the processor 110 makes a positive determination (e.g., "YES) in step S440*a*. In the first illustrative embodiment, in step S440 (refer to FIG. 6), the processor 110 determines whether a particular condition is satisfied based on the pixel frequency of at least one particular pixel included in any pass other than the target pass. Nevertheless, in the second illustrative embodiment, in step S440*a*, the processor 110 determines whether the particular condition is satisfied based on the pixel frequency of at least one particular pixel included in the pass immediately subsequent to the target pass. That is, the condition used in step S440*a* may be that, when an L-th band image is specified as the target band image, a predetermined number (e.g., the pixel frequency threshold) or more of color-gap-causing pixels included in a specific color range including the pixel including in the L-th band image are included in an (L+1)-th band image.

Such control may thus reduce occurrence of a conspicuous color gap that may be caused by the difference in direction of ejection processing between adjacent band images. In a case where a plurality of color-gap-causing pixels having similar colors are included in a plurality of band images that are not adjacent to each other, the band images are printed relatively far from each other on a sheet PM. Thus, a color gap between the band images that are distant from each other may be less conspicuous as compared with a case where a plurality of color-gap-causing pixels having similar colors are included in adjacent band images. In the second illustrative embodiment, in such a case, in each of steps S340*a* and S440*a*, the processor 110 determines that the particular condition is not satisfied. Therefore, the printing execution unit 290 performs bidirectional printing. Such control may thus improve a printing speed.

C. Third Illustrative Embodiment

Figure 9:
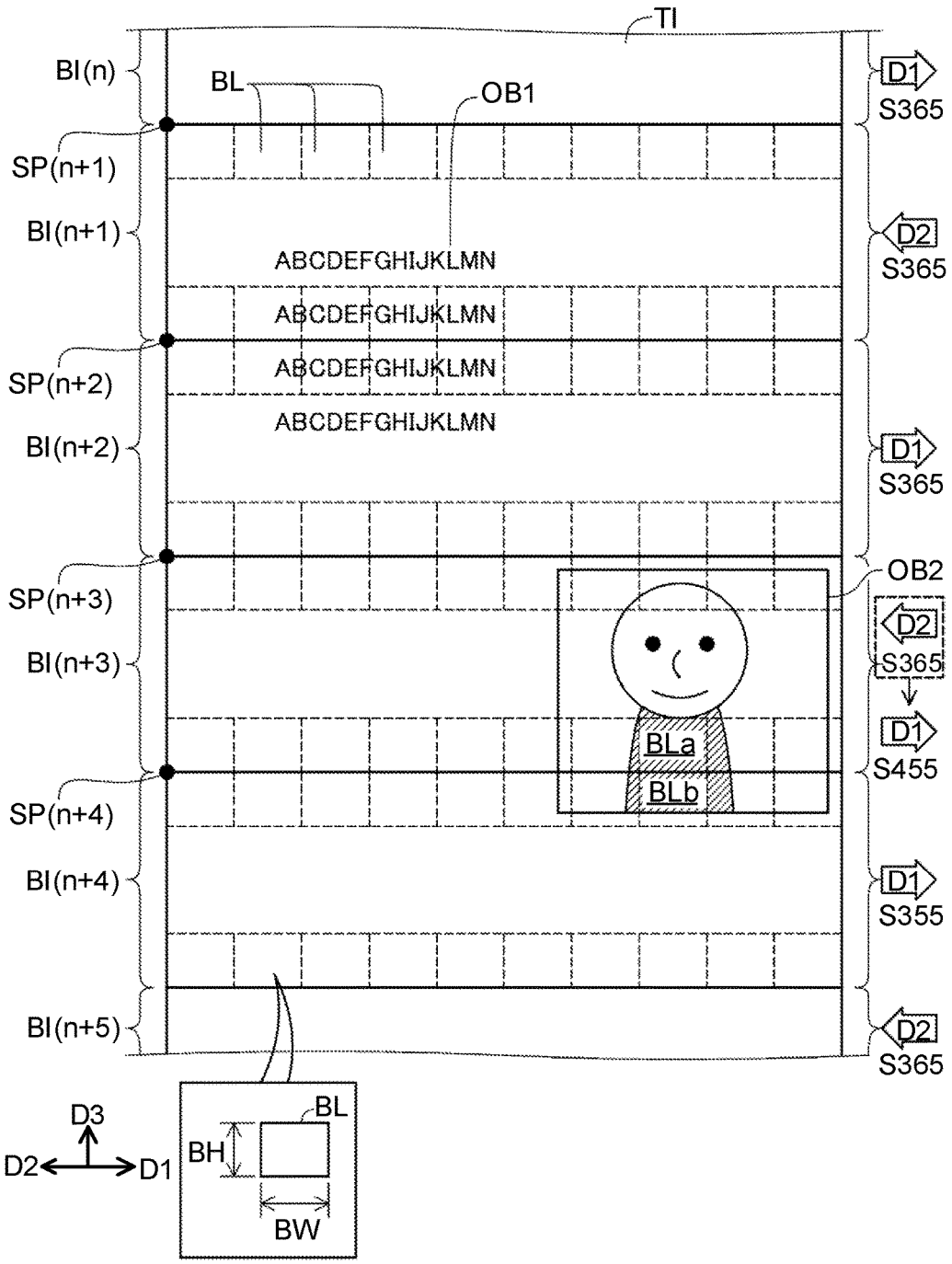
FIG. 9 illustrates a plurality of blocks included in each band image in a third illustrative embodiment according to one or more aspects of the disclosure.

Referring to FIG. 9, an explanation will be provided on another example of a plurality of blocks included in each band image according to a third illustrative embodiment. FIG. 9 illustrates the same target image TI including a plurality of band images BI as the target image TI illustrated in FIG. 7. In the third illustrative embodiment, in each band image BI, blocks BL are defined in its end regions with respect to the sub-scanning direction D3 only. Each block BL is in contact with one or the other of ends of a band image BI with respect to the sub-scanning direction D3. Only these block BL may be used for determination. In each band image BI, no block BL is defined in the other region (e.g., an interior region) that does not contact the one and other ends of the band image BI with respect to the sub-scanning direction D3. The image processing executed in the third illustrative embodiment is the same or similar to the image processing executed in the first illustrative embodiment (refer to FIGS. 4, 5, and 6).

In step S307 (refer to FIG. 5), the processor 110 identifies only a plurality of blocks BL each contacting one or the other of ends of a target band image with respect to the sub-scanning direction D3. In step S325, the processor 110 calculates an evaluation value of a target block BL. In step S335, the processor 110 determines, based on the evaluation value of the target block BL, whether the first color condition is satisfied. The internal region not contacting on the one or the other of the ends of the target block BL with respect to the sub-scanning direction D3 is not used for determination in step S335. According to the third illustrative embodiment, if the processor 110 determines that the evaluation value of the target block BL is greater than or equal to the evaluation value threshold, the processor 110 makes a positive determination (e.g., "YES") in step S335. Such control may thus reduce occurrence of a conspicuous color gap that may be caused between blocks bordering adjacent band images by difference in the direction of ejection processing.

In the gap table 300 (refer to FIG. 3), each pixel frequency 303 may indicate an occurrence frequency of a corresponding pixel in bordering blocks BL in a band image. In steps S340 (refer to FIG. 5) and S440 (refer to FIG. 6), the processor 110 determines, based on the pixel frequency of a color-gap-causing pixel included in the target block, whether the second color condition is satisfied. The processor 110 performs the same determination on each pixel representing a respective similar color to a color of a respective particular one of the pixels included in the target block. Such control may thus reduce occurrence of a conspicuous color gap that may be caused between a particular block and any band image to be printed prior to a band image including the particular block, due to the difference in direction of ejection processing in the bordering block.

In each band image BI, an interior region is not contact with any of the other band images. Thus, if an internal region of a band image includes a pixel that may cause a relatively large degree due to the difference in ink overlapping order, there may be a low possibility that a color gap between an internal region of one band image and an internal region of another band image is conspicuous. In each of steps S340*a* and S440*a* according to the second illustrative embodiment (refer to FIGS. 8A and 8B), block BL contacting one or the other of ends of a band image may be used for the determination.

D. Variations (1) Each weight 302 (refer to FIG. 3) might not necessarily indicate the degree of difference between the measured values. In other embodiments, for example, each weight 302 may be a value indicating a degree of difference between color values representing a color to be printed. In one example, a photograph of the patch printed by the ejection processing in the forward direction D1 and a photograph of the patch printed by the ejection processing in the reverse direction D2 may be taken using a digital camera. A difference in RGB value between the patch images (e.g., Euclidean distance in the color cube CC) may be obtained. The value indicating the degree of the difference may be adopted as a weight 302. In such a case, the weight 302 may be a value that is the same as the difference between color values. A predetermined value may be assigned to the each difference between color values in advance. As described above, the weight 302 may be any value having correlation to the difference between color values. In any cases, it may be preferable that a greater value is assigned to the weight 302 with a greater difference between color values.

In another example, each weight 302 may indicate a degree of color gap based on the evaluation result of the observer who observed the patches. In still another example, each weight 302 may be determined based on the human evaluation result and the difference between color values representing a color to be printed.

(2) The evaluation value obtained in step S325 of FIG. 5 may be any value indicating a degree of color gap due to the difference in ink overlapping order that is associated with one of pixels included in the target block. In one example, the evaluation value may be a normalized value that may be obtained by dividing an average value of weights 302 of pixels included in the target block by a value of the highest weight 302 of the pixel included in the target block. Instead of using the average value, a highest value, a median value, a mode value, or a lowest value among weights of pixels included in the target block may be used as the evaluation value. All pixels included in the target block might not necessarily be used for determination of the evaluation value. In another example, pixels equally selected from the target block (e.g., pixels positioned in even-number columns only may be selected from pixels in a matrix) may be used for determination of the evaluation value. In either of the above examples, the condition that the evaluation value is greater than or equal to the evaluation value threshold may indicate that a relatively large degree of color gap may be caused due to the difference in ink overlapping direction. The color condition determined in step S335 (refer to FIG. 5) may be that a relatively large color gap may occur between a color of a first image to be printed by ejection processing in the forward direction D1 using a pixel included in band image data representing the target band image and a color of a second image to be printed by ejection processing in the reverse direction D using the same pixel.

(3) In step S320 (refer to FIG. 5), the pixel frequency might not necessarily be determined with respect to all of the grids GD (i.e., the pixels) illustrated in FIG. 3. In other embodiments, for example, the pixel frequency may be determined with respect to one or more grids GD each assigned with a relatively large weight 302 (e.g., a weight 302 greater than or equal to a predetermined threshold) only. Generally, in step S320, it may be preferable to determine a pixel frequency associated to a color-gap-causing pixel that may be used in the determination in each of steps S340 (refer to FIG. 5), S440 (refer to FIG. 6), S340*a* (refer to FIG. 8A), and S440*a* (refer to FIG. 8B).

For determination of the pixel frequency in step S320, all pixels included in a band image might not necessarily be used. In other embodiments, for example, among pixels arranged in a matrix in a band image, pixels positioned in even-numbered columns may be used for determination of the pixel frequency.

In step S320 (refer to FIG. 5), the pixel frequency may be determined per pixel instead of per grid color range. In such a case, in each of steps S340 (refer to FIG. 5), S440 (refer to FIG. 6), S340*a* (refer to FIG. 8A), and S440*a* (refer to FIG. 8B), the processor 110 may determine, based on a single pixel, whether the second color condition is satisfied. For example, the second color condition may be that another band image includes a predetermined number (e.g., the pixel frequency threshold) or more of color-gap-causing pixels, each of which is included in a target band image and that may cause a relatively large gap due to the difference in ink overlapping order (e.g., a pixel whose weight (refer to FIG. 3) is larger than or equal to a threshold). In such a case, a color range used for identifying a color-gap-causing pixel to be used for the determination as to whether the second color condition is satisfied may be a color range indicating a single pixel but not a grid color range.

(4) The frequency threshold used in step S340 may be a variable. For example, the processor 110 may change the value of the frequency threshold such that a smaller pixel frequency threshold may be used when the evaluation value for the target block is greater. In step S340, in one example, the processor 110 determines, with respect to each pixel included in a target block, whether the condition is satisfied. In another example, the processor 110 determines, with respect to only a pixel that may cause a relatively large color gap due to the difference in ink overlapping order (e.g., a pixel whose weight 302 (refer to FIG. 3) is larger than or equal to a threshold), whether the condition is satisfied. The same may be applied to processing executed in each of step S440 (refer to FIG. 6), S340 (refer to FIG. 8A), and S440*a* (refer to FIG. 8B).

(5) Other processing may be adopted for the processing for determining the direction of the ejection processing. For example, the processor 110 may determine the pixel frequency of each pixel included in each pass and then execute the processing of steps S310 to S360 (other than step S320). In such a case, in step S355, the processor 110 might not necessarily determine the predetermined direction as the pass direction for a target band image. For example, the processor 110 may determine the same direction as the direction of a particular pass to be executed prior to the target pass, as the pass direction for a target band image. The particular pass may include a pixel that represents a similar color to a color of a pixel included in the target block and whose pixel frequency is greater than or equal to the pixel frequency threshold.

(6) The printing execution unit 290 may have another configuration. For example, the head moving unit 294 may have another configuration that may enable the print head 292 to reciprocate along the main scanning direction. The forward direction may be one direction or the other direction of the bi-directional main scanning direction. For example, the second direction D2 may correspond to the forward direction, and the first direction D1 may correspond to the reverse direction. The conveying unit 296 may have another configuration for conveying a sheet PM in the sub-scanning direction. The printing execution unit 290 may handle two or more colors of ink (color materials). For example, the printing execution unit 290 may handle three colors, e.g., cyan C, magenta M, and yellow Y, of ink. The print head 292 may include the same number of nozzle groups as the number of colors of ink preferably. That is, the print head 292 may include J (J is an integer of 2 or greater) nozzle groups, and the J nozzle groups may eject respective different coloring materials. With this configuration, the print head 292 may include the minimum number of nozzle groups, thereby simplifying the configuration of the print head 292. In such a configuration, two nozzle groups arbitrarily selected from a plurality of nozzle groups of the print head 292 may eject respective different inks.

Target image data may have another format instead of the RGB bitmap format. For example, target bitmap image data of YCbCr color space may be used in print processing. As described above, pixel values represented by another color space, such as YCbCr pixel values, may be used in print processing, instead of the RGB values.

(7) In one example, as a substitute for the image processing apparatus 100 (refer to FIG. 1), the controller 298 of the multifunction device 200 may execute the print processing of FIG. 4. More specifically, for example, the processor 210 may execute the print processing of FIG. 4 in accordance with the program 232. In such a case, the controller 298 of the multifunction device 200 may operate as an image processing apparatus. In another example, the controller 298 of the printing execution unit 290 may execute part of the print processing (e.g., steps S230 and S220) of FIG. 4. The controller 298 of the printing execution unit 290 may be omitted. In such a case, the image processing apparatus may control the printing execution unit 290 directly. In both cases, data including image data representing a target image and information representing the direction of the ejection processing determined in step S210 may be adopted as the print data for controlling the printing execution unit 290.

(8) The image processing apparatus 100 (refer to FIG. 1) may be another device (e.g., a digital camera or a scanner) other than the general-purpose computer. The device including the printing execution unit may be another device (e.g., a single-function printer) other than the multifunction device 200. The image processing apparatus may be built in a device including the printing execution unit. A plurality of devices (e.g., computers) that can communicate with each other through a network may share an image processing function of the image processing apparatus to provide the image processing function entirely. In such a case, a system including those devices may correspond to the image processing apparatus.

Part of the configurations implemented by hardware in the above-described illustrative embodiment may be replaced with software, or conversely, part of the configurations implemented by software in the above-described illustrative embodiment may be replaced with hardware. For example, functions achieved in steps S220, S230, and S240 may be implemented by a dedicated hardware circuit.

In a case where part or entire function of the disclosure is implemented by a computer program, the program may be supplied with being stored in a computer-readable storage medium (e.g., a non-transitory storage medium). The program may be used with being stored in the same or different storage medium (e.g., a computer-readable storage medium) as supplied. The "computer-readable storage medium" is not limited to a portable storage medium such as a memory card or a CD-ROM but may also include an internal storage device of a computer (e.g., various ROMs) and an external storage device (e.g., a hard disk drive) connected to the computer.

Although the disclosure has been described based on illustrative embodiments and variations, the illustrative embodiments of the disclosure facilitate the understanding of the disclosure and do not limit the disclosure. The disclosure may be changed or modified without departing from the spirit of the invention and the scope of the claims and includes the equivalents thereof.

What is claimed is:

1. An image processing apparatus for enabling a printing execution unit to execute image printing, the printing execution unit comprising a print head including a plurality of nozzle groups, the plurality of nozzle groups including a first nozzle group and a second nozzle group, the image processing apparatus comprising a controller configured to perform:

acquiring target image data;

determining a direction of moving of the print head among a forward direction and a reverse direction in a main scanning direction for band image data included in the target image data; and causing the printing execution unit to alternately repeat an ejection process and a moving process for enabling the printing execution unit to print a target image represented by the target image data, the ejection process for ejecting color materials onto a print medium by moving the print head in one of the forward direction and the reverse direction to form a band image represented by corresponding band image data along the main scanning direction using the plurality of nozzle groups, the ejection process includes a first ejection process and a second ejection process, the first ejection process for ejecting, by moving the print head in the forward direction, a first color material from the first nozzle group onto a first specific position of the print medium followed by a second color material from the second nozzle group, the second ejection process for ejecting, by moving the print head in the reverse direction, the second color material from the second nozzle group onto a second specific position of the print medium followed by the first color material from the first nozzle group, and the moving process for moving the print medium in a sub-scanning direction relative to the print head, wherein the controller determines the direction of moving of the print head by:

determining whether an L-th (L is an integer of 2 or greater) band image formed by an L-th ejection process satisfies a first color condition, the first color condition associated with a color difference between a first image to be printed and a second image to be printed, the first image being printed by the first ejection process in the forward direction using a pixel included in L-th band image data representing the L-th band image, and the second image being printed by the second ejection process in the reverse direction using a pixel included in the L-th band image data representing the L-th band image, determining whether the L-th band image satisfies a second color condition, the second color condition representing that a predetermined number or more of pixels in a specific color range are included in another band image different from the L-th band image, a pixel of the pixels being associated with a color difference between a color to be printed using the pixel in the first ejection process in the forward direction and a color to be printed using the pixel in the second ejection process in the reverse direction, the specific color range being a color range including a color represented by a pixel in the L-th band image;

determining, as the direction of moving of the print head in the L-th ejection process, a same direction as the direction of moving of the print head in the ejection process for another band image including the predetermined number or more of the pixels in a case where it is determined that both of the first color condition and the second color condition are satisfied; and determining, as the direction of moving of the print head in the L-th ejection process, an opposite direction to moving of the print head in an (L−1)-th ejection process in a case where it is determined that at least one of the first color condition and the second color condition is not satisfied.

2. The image processing apparatus according to claim 1, wherein the controller is further configured to perform:

specifying an evaluation value of partial data based on color gap information, the partial data representing each of a plurality of partial images included in the band image, wherein the color gap information represents, for each pixel of a plurality of pixels, a correspondence between a pixel value and a degree of a color gap, wherein the degree of the color gap is based on a difference between a first image to be printed using a pixel by the first ejection process in the forward direction and a second image to be printed using the pixel by the second ejection process in the reverse direction, and wherein the controller determines whether the first color condition is satisfied based on the evaluation value.

3. The image processing apparatus according to claim 2, wherein the degree of the color gap correlates to a difference between a color value representing the first color condition and a color value representing the second color condition.

4. The image processing apparatus according to claim 2, wherein the controller determines whether the first color condition is satisfied based on the evaluation value of a bordering partial image in the L-th band image, the bordering partial image bordering an (L−1)-th or an (L+1)-th band image.

5. The image processing apparatus according to claim 2, wherein the controller specifies the evaluation value of the partial data by calculating a value based on at least one of (1) an average value, (2) a highest value, (3) a median value (4) a mode value and (5) a lowest value of the degree of the color gaps, each of the degree of the color gaps corresponding to each pixel of the plurality of pixels.

6. The image processing apparatus according to claim 1, wherein the controller determines a predetermined direction among the forward direction and the reverse direction, as the direction of moving of the print head in the L-th ejection process, in a case where it is determined that both of the first color condition and the second color condition are satisfied.

7. The image processing apparatus according to claim 1, wherein the controller is further configured to perform:

specifying a frequency of the pixels in the specific color range for each of a plurality of band images from a first band image to the L-th band image based on band image data corresponding to each of the plurality of band images from the first band image to the L-th band image, and wherein the controller determines whether the L-th band image satisfies the second color condition based on the frequency of the pixels in the specific color range for each of the plurality of band images from the first band image to an (L−1)-th band image.

8. The image processing apparatus according to claim 1, wherein the second color condition includes a condition that a specific number of the pixels are included in an (L−1)-th band image.

9. The image processing apparatus according to claim 1, wherein the controller causes the printing execution unit to execute the ejection process for an (L−1)th band image by moving the print head in only one of the forward direction and the reverse direction followed by executing the ejection process for the L-th band image by first moving the print head in the opposite direction to the one of the forward direction and the reverse direction.

10. The image processing apparatus according to claim 1, wherein the controller causes the printing execution unit to execute the ejection process for the L-th band image by moving the print head only in one of the forward direction or the reverse direction, and wherein the controller causes the printing execution unit to execute the moving process by moving the print medium in the sub-scanning direction a specific conveying amount after finishing execution of the ejection process for the L-th band image, the specific conveying amount being identical to a width of the L-th band image in the sub-scanning direction.

11. A non-transitory computer readable storage medium storing instructions, the instructions, when executed by a controller of an image processing apparatus, causing the image processing apparatus to perform:

acquiring target image data;

determining a direction of moving of a print head among a forward direction and a reverse direction in a main scanning direction for band image data included in the target image data; and causing a printing execution unit to alternately repeat an ejection process and a moving process for enabling the printing execution unit to print a target image represented by the target image data, the ejection process for ejecting color materials onto a print medium by moving the print head in one of the forward direction and the reverse direction to form a band image represented by corresponding band image data along the main scanning direction using a plurality of nozzle groups, the ejection process includes a first ejection process and a second ejection process, the first ejection process for ejecting, by moving the print head in the forward direction, a first color material from a first nozzle group onto a first specific position of the print medium followed by a second color material from a second nozzle group, the second ejection process for ejecting, by moving the print head in the reverse direction, the second color material from the second nozzle group onto a second specific position of the print medium followed by the first color material from the first nozzle group, and the moving process for moving the print medium in a sub-scanning direction relative to the print head, wherein the controller determines the direction of moving of the print head by:

determining whether an L-th (L is an integer of 2 or greater) band image formed by an L-th ejection process satisfies a first color condition, the first color condition associated with a color difference between a first image to be printed and a second image to be printed, the first image being printed by the first ejection process in the forward direction using a pixel included in L-th band image data representing the L-th band image, and the second image being printed by the second ejection process in the reverse direction using a pixel included in the L-th band image data representing the L-th band image, determining whether the L-th band image satisfies a second color condition, the second color condition representing that a predetermined number or more of pixels in a specific color range are included in another band image different from the L-th band image, a pixel of the pixels being associated with a color difference between a color to be printed using the pixel in the first ejection process in the forward direction and a color to be printed using the pixel in the second ejection process in the reverse direction, the specific color range being a color range including a color represented by a pixel in the L-th band image;

determining, as the direction of moving of the print head in the L-th ejection process, a same direction as the direction of moving of the print head in the ejection process for another band image including the predetermined number or more of the pixels in a case where it is determined that both of the first color condition and the second color condition are satisfied; and determining, as the direction of moving of the print head in the L-th ejection process, an opposite direction to moving the print head in an (L−1)-th ejection process in a case where it is determined that at least one of the first color condition and the second color condition is not satisfied.

12. A method for enabling a printing execution unit to execute image printing, the printing execution unit comprising a print head including a plurality of nozzle groups, the plurality of nozzle groups including a first nozzle group and a second nozzle group, the method comprising:

acquiring target image data;

determining a direction of moving of the print head among a forward direction and a reverse direction in a main scanning direction for band image data included in the target image data; and causing the printing execution unit to alternately repeat an ejection process and a moving process for enabling the printing execution unit to print a target image represented by the target image data, the ejection process for ejecting color materials onto a print medium by moving the print head in one of the forward direction and the reverse direction to form a band image represented by corresponding band image data along the main scanning direction using the plurality of nozzle groups, the ejection process includes a first ejection process and a second ejection process, the first ejection process for ejecting, by moving the print head in the forward direction, a first color material from the first nozzle group onto a first specific position of the print medium followed by a second color material from the second nozzle group, the second ejection process for ejecting, by moving the print head in the reverse direction, the second color material from the second nozzle group onto a second specific position of the print medium followed by the first color material from the first nozzle group, and the moving process for moving the print medium in a sub-scanning direction relative to the print head, wherein the determining the direction of moving of the print head is performed by:

determining whether an L-th (L is an integer of 2 or greater) band image formed by an L-th ejection process satisfies a first color condition, the first color condition associated with a color difference between a first image to be printed and a second image to be printed, the first image being printed by the first ejection process in the forward direction using a pixel included in L-th band image data representing the L-th band image, and the second image being printed by the second ejection process in the reverse direction using a pixel included in the L-th band image data representing the L-th band image, determining whether the L-th band image satisfies a second color condition, the second color condition representing that a predetermined number or more of pixels in a specific color range are included in another band image different from the L-th band image, a pixel of the pixels being associated with a color difference between a color to be printed using the pixel in the first ejection process in the forward direction and a color to be printed using the pixel in the second ejection process in the reverse direction, the specific color range being a color range including a color represented by a pixel in the L-th band image;

determining, as the direction of moving of the print head in the L-th ejection process, a same direction as the direction of moving of the print head in the ejection process for another band image including the predetermined number or more of the pixels in a case where it is determined that both of the first color condition and the second color condition are satisfied; and determining, as the direction of moving of the print head in L-th ejection process, an opposite direction to moving of the print head in an (L−1)-th ejection process in a case where it is determined that at least one of the first color condition and the second color condition is not satisfied.

* * * * *